US005979713A

United States Patent [19]

Grill

[11] Patent Number: 5,979,713

[45] Date of Patent: Nov. 9, 1999

[54] TAP ASSEMBLY ADAPTED FOR A FLUID DISPENSER

[75] Inventor: Benjamin Grill, Woodland Park, Colo.

[73] Assignee: Sturman BG, LLC, Woodland Park, Colo.

[21] Appl. No.: 08/926,059

[22] Filed: Sep. 9, 1997

[51] Int. Cl.[6] ..... B67C 3/00

[52] U.S. Cl. ..... 222/399; 222/505; 251/9

[58] Field of Search ..... 222/399, 5, 6, 222/212, 214, 505; 251/4, 9

[56] References Cited

U.S. PATENT DOCUMENTS

| | | | |
|---|---|---|---|
| 3,100,102 | 8/1963 | Haan | 251/9 |
| 3,900,136 | 8/1975 | Paranto | 251/9 |
| 4,526,730 | 7/1985 | Cochan et al. | 261/121 R |
| 5,022,565 | 6/1991 | Sturman et al. | 222/396 |
| 5,110,012 | 5/1992 | Scholle et al. | 222/83.5 |
| 5,395,012 | 3/1995 | Grill et al. | 222/4 |
| 5,443,186 | 8/1995 | Grill | 222/396 |

FOREIGN PATENT DOCUMENTS

| | | | |
|---|---|---|---|
| 0 581 492 A1 | 2/1994 | European Pat. Off. | B67D 3/00 |
| 1 532 637 | 3/1970 | Germany | 64/34 |
| 86 22 878 | 11/1986 | Germany | B67C 3/00 |

OTHER PUBLICATIONS

Product Information, Wecomatic Metallwarenfabrik, 7 pages, date unknown.

*Primary Examiner*—Steven O. Douglas
*Attorney, Agent, or Firm*—Anthony N. Woloch

[57] ABSTRACT

Herein disclosed is an improved tap assembly including a tap, a delivery tube, and a rotatable cam for selectively compressing or not compressing a resilient flow control portion of the delivery tube in order to block or allow fluid flow therethrough. Also included is a decompression device for positively ensuring unrestricted flow through the resilient flow control portion when the cam is rotated to its opened position. The dispensed fluid may be pressurized by pre-mixing with another fluid supplied by a manifold. The manifold is adapted to be connected to multiple pressurized sources of the another fluid. A diffuser is provided upstream of the flow control portion in order to effectively condition the dispensed fluid to desired characteristics such as reduced velocity, laminar flow, and appearance. The tap and manifold have matable piloting members for easily guiding these components together in correct relation for a snap assembly. The tap assembly may dispense, for example, pressurized liquid beverages such as beer, wine, soft drinks, and the like. The subject invention may also be used to dispense non-pressurized liquids such as intravenously-fed medicine, food or nutrients, and the like.

30 Claims, 25 Drawing Sheets

TAP ASSEMBLY ADAPTED FOR A FLUID DISPENSER

TECHNICAL FIELD

The present invention relates generally to fluid dispensers and, more particularly, to flow control devices adapted for dispensers of fluid including but not limited to liquid beverages, body transfusion medicine, and the like.

BACKGROUND ART

Beverages, such as beer and soft drinks, are typically pressurized with carbon dioxide gas ($CO_2$) to improve their taste and appearance. The beverage is then sealed in a container, such as a can or bottle, to maintain the beverage in its carbonated state. Other beverages, such as wine, may be pressurized with an inert gas, such as nitrogen gas ($N_2$), for displacing air which could eventually spoil such beverages. Prolonged or repeated opening of the container for consumption allows significant amounts of the pressurized gas to escape. The escape of such gas ultimately results in the beverage tasting flat, looking unappealing, and/or spoiling. It is therefore desirable to periodically recharge such beverages with a suitable pressurized gas to extend the useful life of such beverages.

U.S. Pat. No. 5,022,565 issued to Sturman et al. on Jun. 11, 1991, U.S. Pat. No. 5,395,012 issued to Grill et al. on Mar. 7, 1995, and U.S. Pat. No. 5,443,186 issued to Grill on Aug. 22, 1995 show various devices which have been proposed for connecting a single pressurized gas cartridge to a beverage container. Such devices are used for maintaining a selected gas pressure on the beverage at all times and/or for dispensing the beverage when desired.

In the above U.S. '565 and U.S. '186 there is shown a pivotal dispensing lever having a nose portion which selectively squeezes a silicon rubber member or flexible hose. A return spring biases the lever towards its closed position. One disadvantage of this arrangement is that the spring-biased lever tends to limit the size of the hose being squeezed. A larger flow cross-sectional-area of the hose is desirable for preventing excessive foaming of the dispensed beverage. Excessive foaming is undesirable because it increases the time required to fill a beverage glass. However, a heavier (i.e., larger-force) return spring is then required to normally squeeze the larger hose shut. Thus with a larger hose, the user must exert undesirably more physical effort to overcome the heavier return spring to dispense the beverage.

Another disadvantage of this arrangement is that repeated squeezing of the flexible hose by the nose portion may cause the hose to fatigue in that portion. If this happens, that portion of the squeezed hose may set and no longer naturally expand to its fully unrestricted state when the nose portion is withdrawn. Consequently, the resultant kink in the hose either permanently blocks beverage flow or at least acts as a flow restriction formed may cause excessive foaming of the dispensed beverage.

U.S. '565 and U.S. '186 also show that the hose has an increasing cross-sectional area of the flow path therein. This is intended to reduce the velocity of the dispensed beverage to an acceptable level for minimizing excessive foaming. However, the diverging cross-sectional flow area of the hose is positioned within the region where the nose portion of the lever squeezes the hose shut. This undesirably limits the effectiveness of the tapered hose to fully condition the exiting velocity and other important flow characteristics of the beverage to an acceptable level.

The present invention is directed to overcoming one or more of the problems as set forth above.

DISCLOSURE OF THE INVENTION

In one aspect of the present invention, there is disclosed a method of operating a tap adapted to dispense a fluid. The tap includes a fluid delivery tube having a resilient flow control portion. The method comprises the steps of applying a first compressive force against the resilient flow control portion, squeezing it under the first compressive force and thereby blocking fluid communication therethrough, releasing the first compressive force, and applying a second compressive force against the resilient flow control portion for ensuring restoration of fluid communication therethrough.

In another aspect of the present invention, there is disclosed a tap assembly adapted for a fluid dispenser having a source of fluid. The tap assembly comprises a fluid delivery tube, having a resilient flow control portion, and a control valve means movable between a closed position and an opened position. The control valve means is operable to selectively i) compress the resilient flow control portion, thereby closing fluid communication therethrough, when the control valve means is moved to its closed position and ii) not compressing the resilient flow control portion, thereby allowing fluid communication therethrough, when the control valve means is moved to its opened position. The tap assembly further includes decompression means for ensuring decompression of the resilient flow control portion when the control valve means is moved to its opened position. The present invention ensures that the resilient flow control portion of the delivery tube is positively opened, when desired, for allowing fluid communication therethrough. A diffuser is preferably positioned upstream of the resilient flow control portion to fully condition the dispensed fluid to desired characteristics such as reduced velocity, laminar flow, and appearance.

In another aspect of the present invention, there is disclosed a tap assembly adapted for a fluid dispenser having a source of fluid. The tap assembly comprises a fluid delivery tube, having a resilient flow control portion, and a cam having a cam lobe. The cam lobe is rotatably movable between i) a first angular position at which the cam lobe compresses the resilient flow control portion thereby closing fluid communication therethrough and ii) a second angular position at which the cam lobe is retracted from the resilient flow control portion thereby allowing fluid communication therethrough. The present invention provides a low-cost tap assembly for controlling the flow of dispensed fluid with minimal physical effort.

In another aspect of the present invention, there is disclosed a modular tap assembly adapted for a fluid mixture dispenser having a source of a first fluid and multiple sources of a second pressurized fluid. The tap assembly comprises a manifold and a tap. The manifold has a common rail passage and a plurality of branch passages separately connected to the common rail passage wherein each branch passage is adapted to be in selective fluid communication with a respective source of the pressurized second fluid. The tap includes a tap chamber having an inlet, connected to the common rail passage of the manifold, and an outlet adapted to be in fluid communication with the source of first fluid. The subject invention provides selective access to multiple sources of pressurized fluid to inexpensively propel variable amounts of the first fluid out of the tap assembly. The tap and manifold are preferably configured to facilitate easy and fool-proof assembly of those components.

The subject invention may be used to dispense, for example, pressurized liquid beverages such as beer, wine, soft drinks, and the like. It may also be used to dispense non-pressurized liquids such as intravenously-fed medicine, food or nutrients, and the like.

BEST MODE FOR CARRYING OUT THE INVENTION

Figure 1:
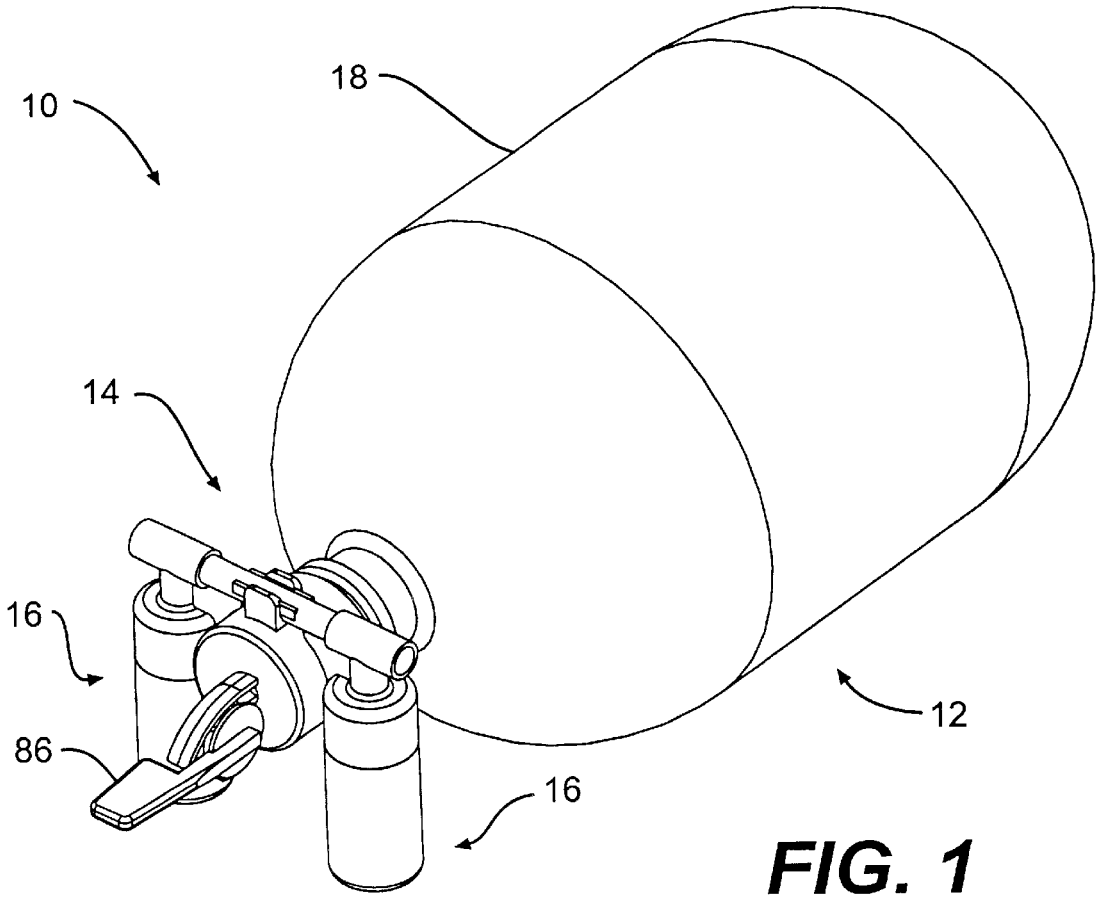
FIG. 1 is a perspective view of a liquid dispenser of the present invention shown in its opened-liquid-flow position.
Figure 60:
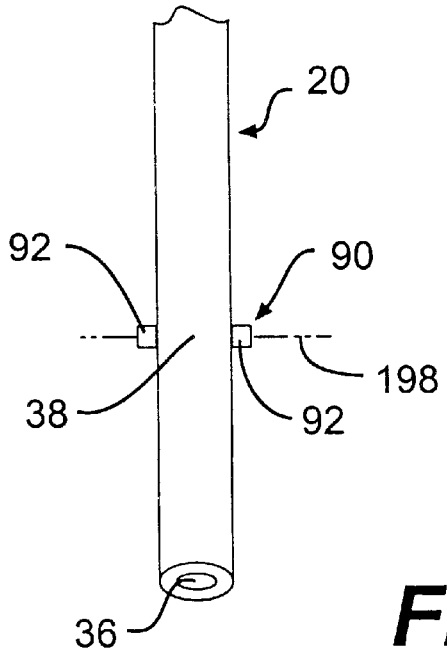
FIG. 60 is a partial view of the fluid delivery tube and the decompression means, which correspond to the liquid dispenser of FIGS. 57–58, wherein the decompression means is shown at its opened-liquid-flow position.

Referring to FIGS. 1–60, wherein similar reference numbers or characters designate similar elements or features throughout the Figs., there is shown an exemplary embodiment of a fluid dispenser 10 of the present invention. While the fluid dispenser 10 may dispense any liquid or gas, the exemplary embodiment is illustrated as adapted for a dispenser of a pressurized liquid beverage such as beer, wine, soft drinks, and the like.

Figure 2:
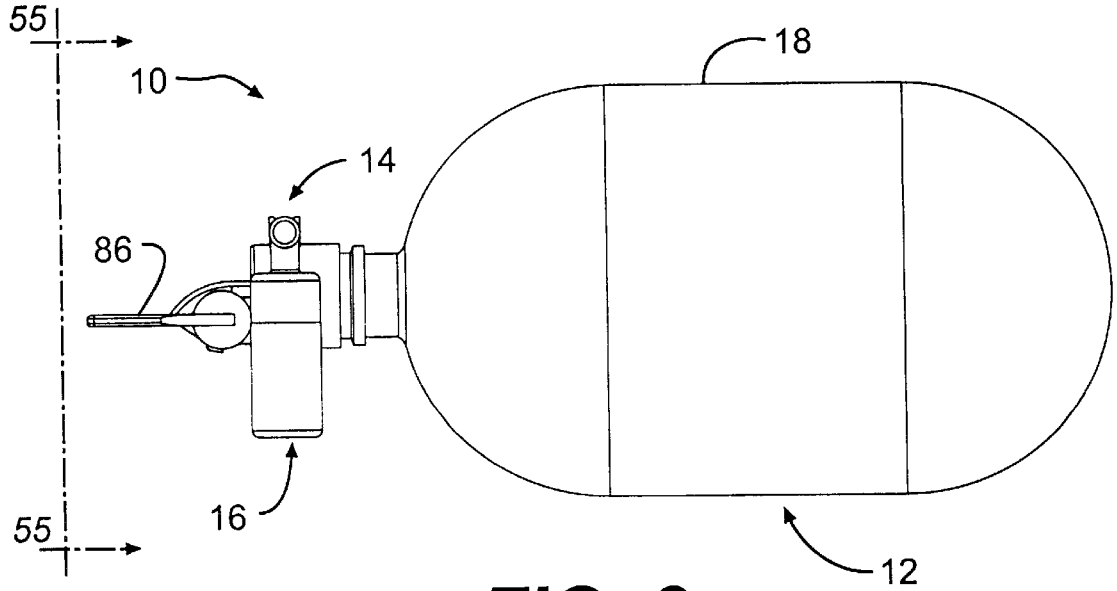
FIG. 2 is a side view of the liquid dispenser shown in FIG. 1.
Figure 3:
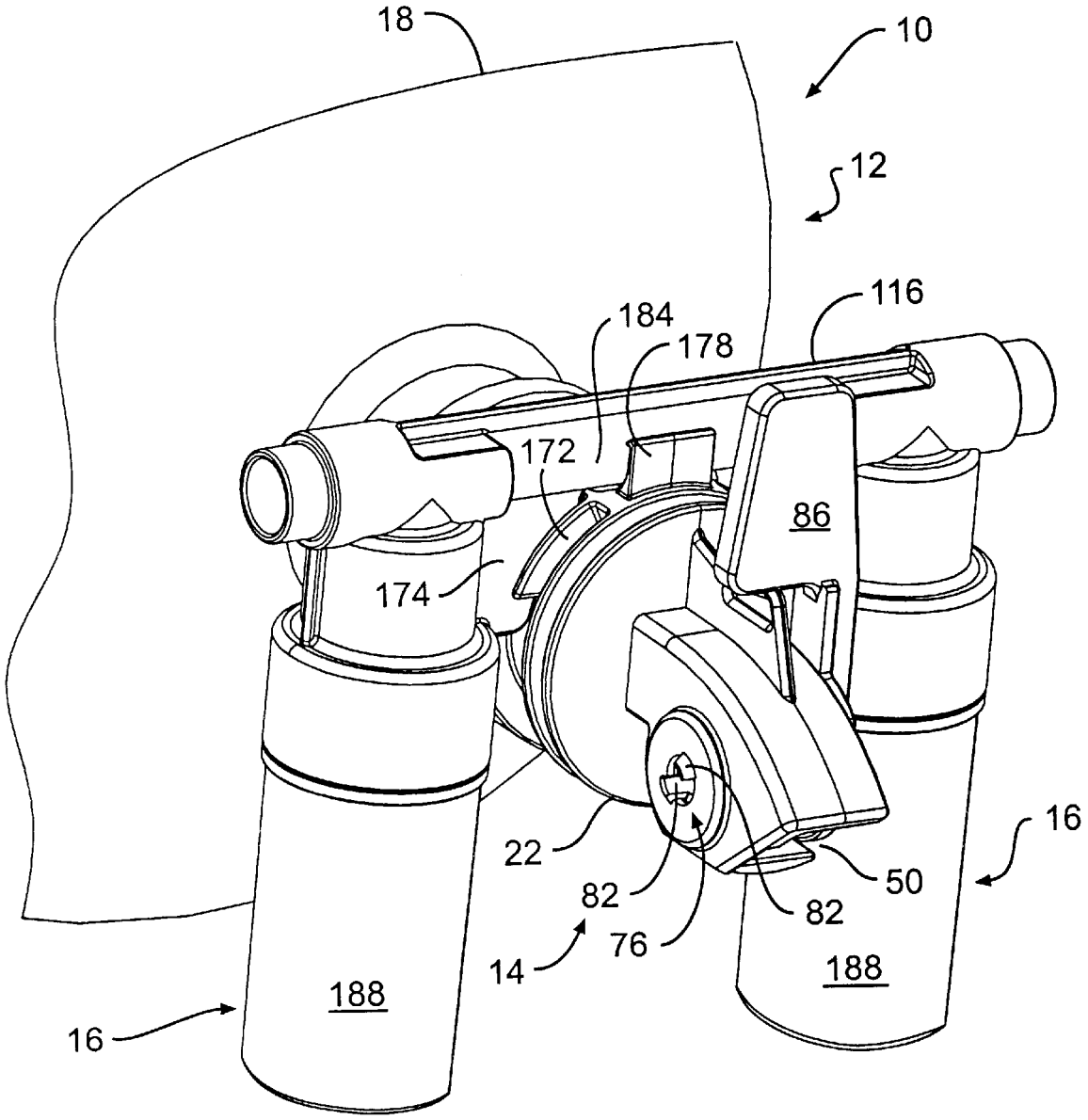
FIG. 3 is an enlarged perspective partial view of the liquid dispenser of FIGS. 1–2 but shown from a different perspective in its closed-liquid-flow position.

As shown in FIGS. 1–3, the liquid dispenser 10 comprises a source 12 of liquid or first fluid, a tap assembly 14 removably connected to the source of liquid, and multiple sources 16 of a pressurized gas or second fluid removably connected to the tap assembly.

The source 12 of liquid preferably includes a container 18, such as a disposable plastic bottle or jug, filled with a liquid beverage. The internal volume of the liquid container 18 is preferably chosen from sizes that are currently popular to beverage consumers (for example, about three liters/101 fluid ounces or about six liters/203 fluid ounces).

Figure 4:
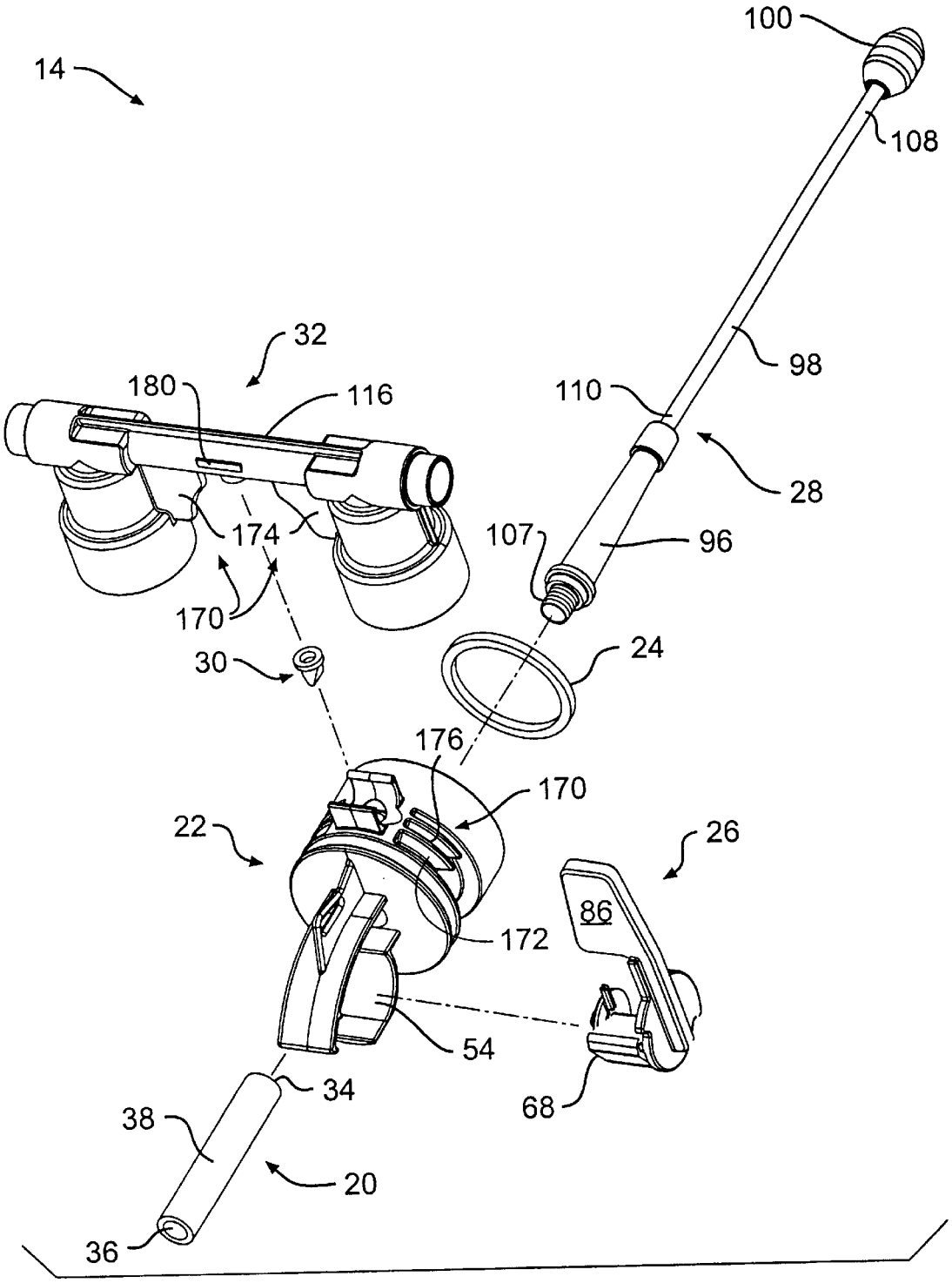
FIG. 4 is an enlarged exploded perspective view of a tap assembly which is part of the liquid dispenser of FIGS. 1–3.

As shown in FIG. 4, the tap assembly 14 includes a fluid delivery tube 20, a tap 22, an annular tap seal 24, a movable control valve means 26, a diffuser assembly 28, check valve means 30, and a manifold assembly 32.

Figure 57:
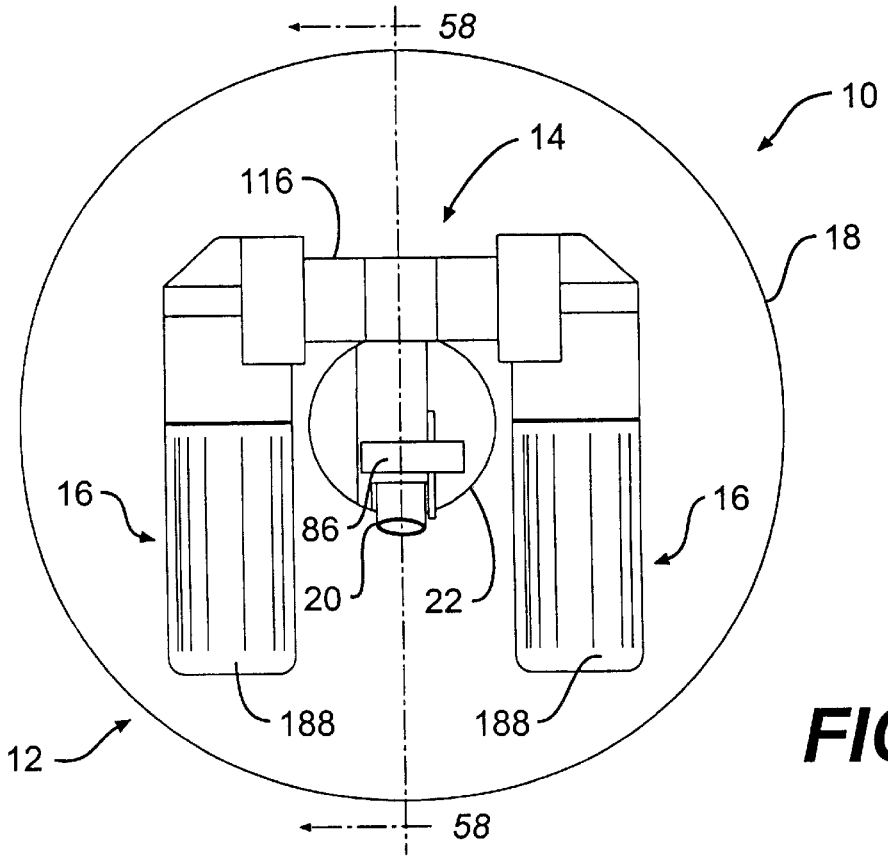
FIG. 57 is a view of the liquid dispenser similar to FIG. 55 but showing the tap assembly in its opened-liquid-flow position.
Figure 58:
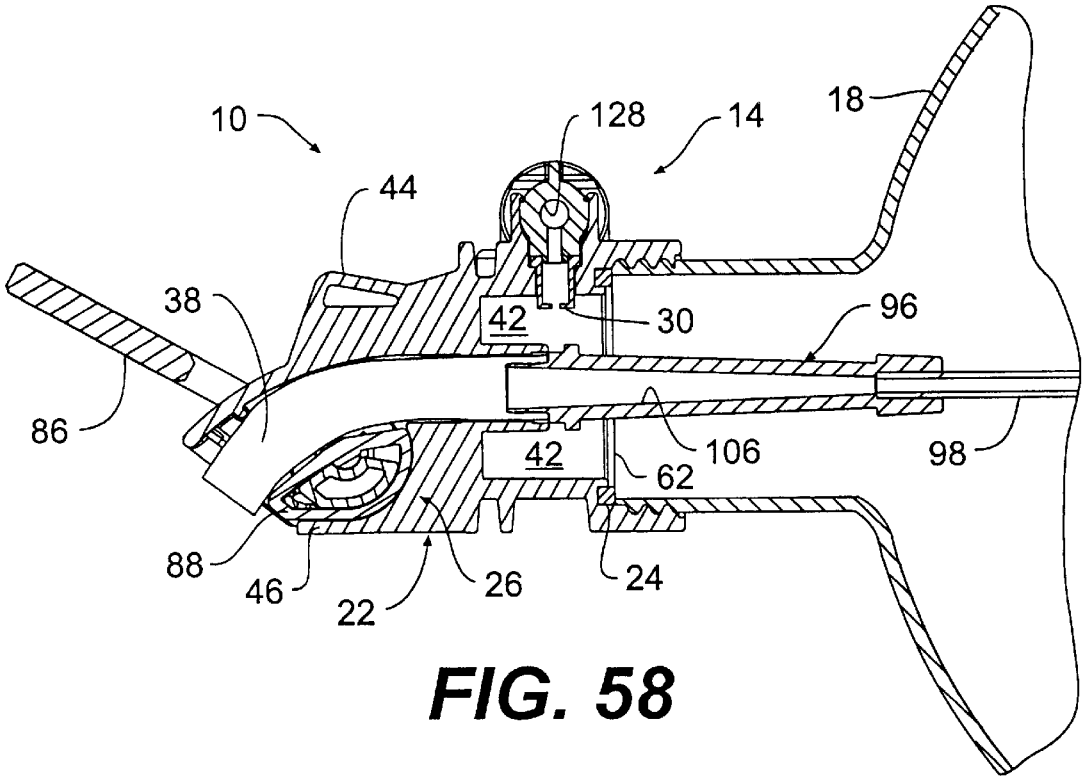
FIG. 58 is a cross-sectional partial view of the liquid dispenser taken generally along line 58—58 of FIG. 57.

The delivery tube 20 includes an inlet 34, an outlet 36, and a resilient flow control portion 38 therebetween. Referring to FIGS. 57–58, the inlet 34 is adapted to be in fluid communication with the source 12 of liquid.

Figure 7:
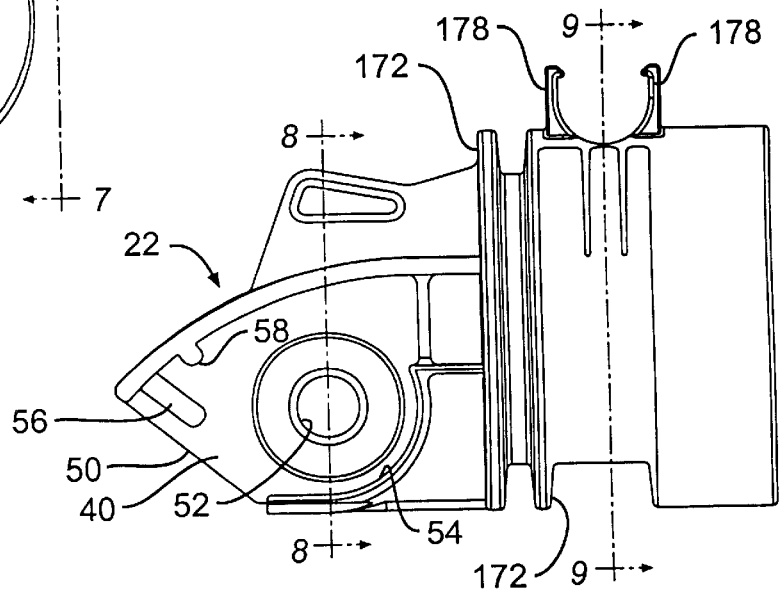
FIG. 7 is a side view of the tap taken generally along line 7—7 of FIG. 6.
Figure 8:
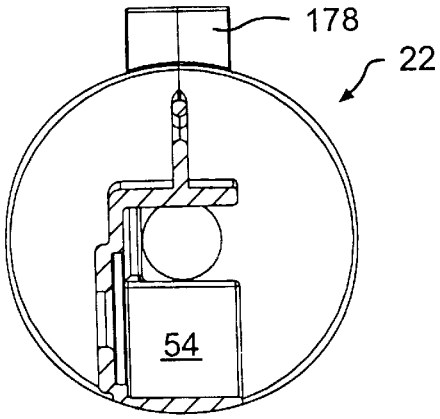
FIG. 8 is a cross-sectional view of the tap taken generally along line 8—8 of FIG. 7.
Figure 9:
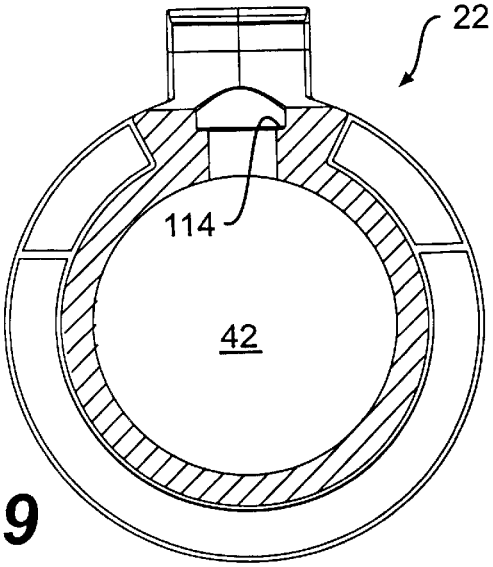
FIG. 9 is another cross-sectional view of the tap taken generally along line 9—9 of FIG. 7.
Figure 10:
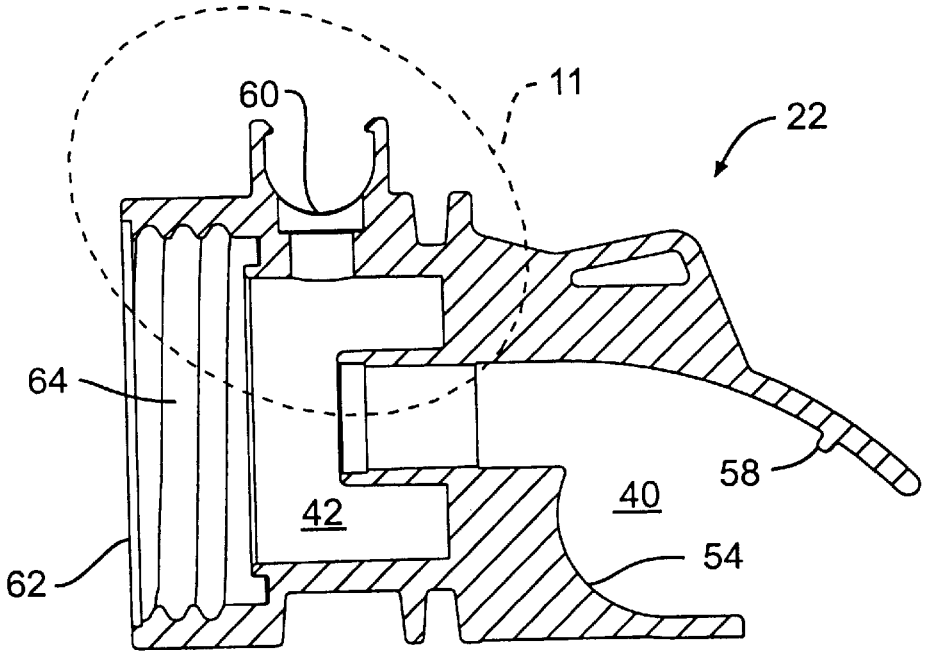
FIG. 10 is still another cross-sectional view of the tap taken generally along line 10—10 of FIG. 6.
Figure 11:
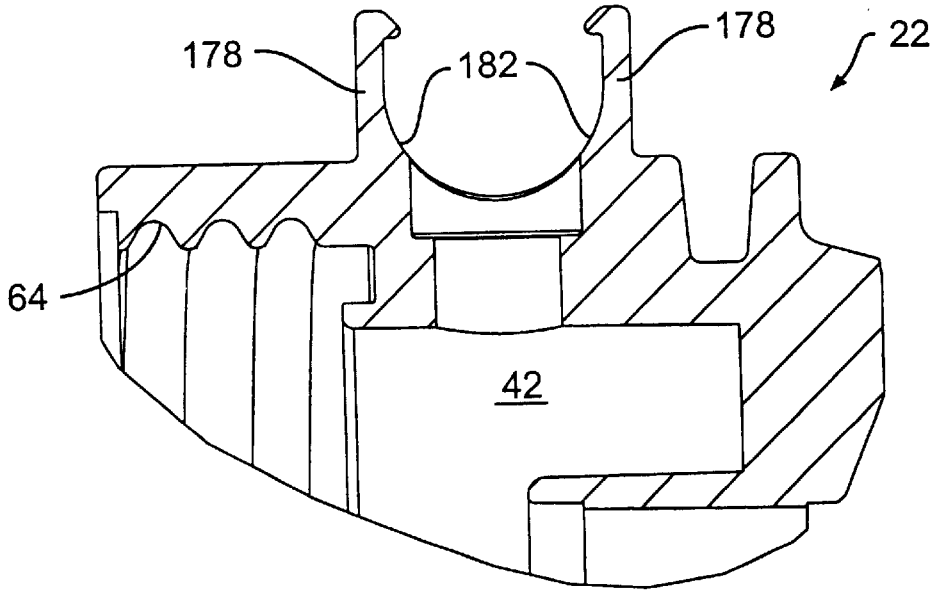
FIG. 11 is an enlarged partial view of the tap taken generally within region 11 of FIG. 10.
Figure 12:
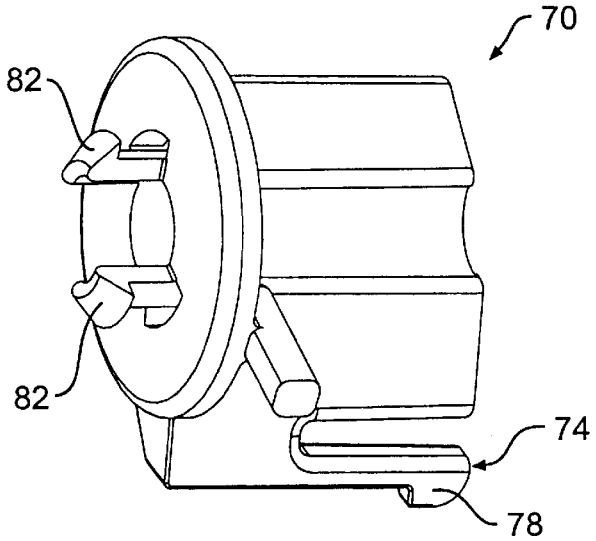
FIG. 12 is an enlarged perspective view of a first lever portion which is part of the tap assembly of FIGS. 4–5.
Figure 13:
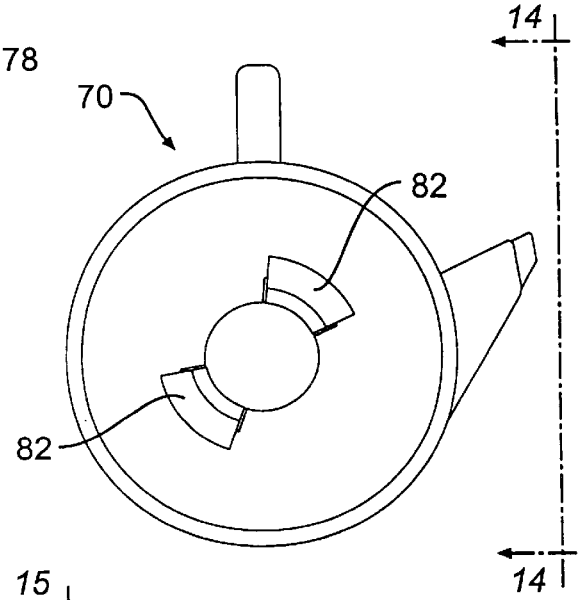
FIG. 13 is an end view of the first lever portion of FIG. 12 but shown rotated somewhat about its axis.
Figure 14:
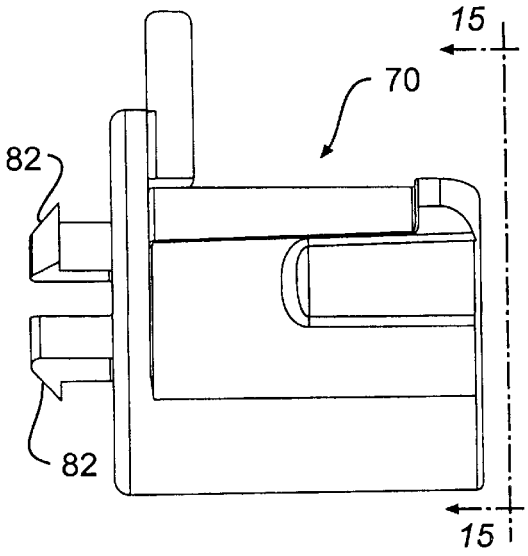
FIG. 14 is a side view of the first lever portion taken generally along line 14—14 of FIG. 13.
Figure 15:
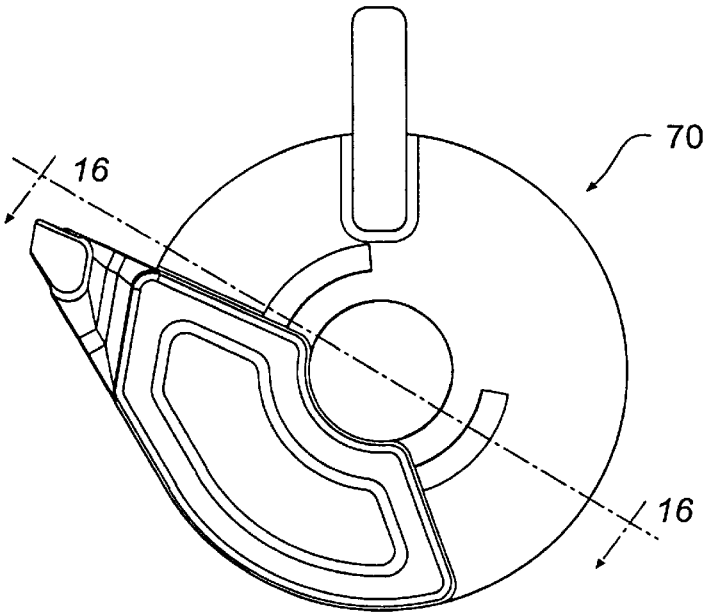
FIG. 15 is an opposite end view of the first lever portion taken generally along line 15—15 of FIG. 14.
Figure 16:
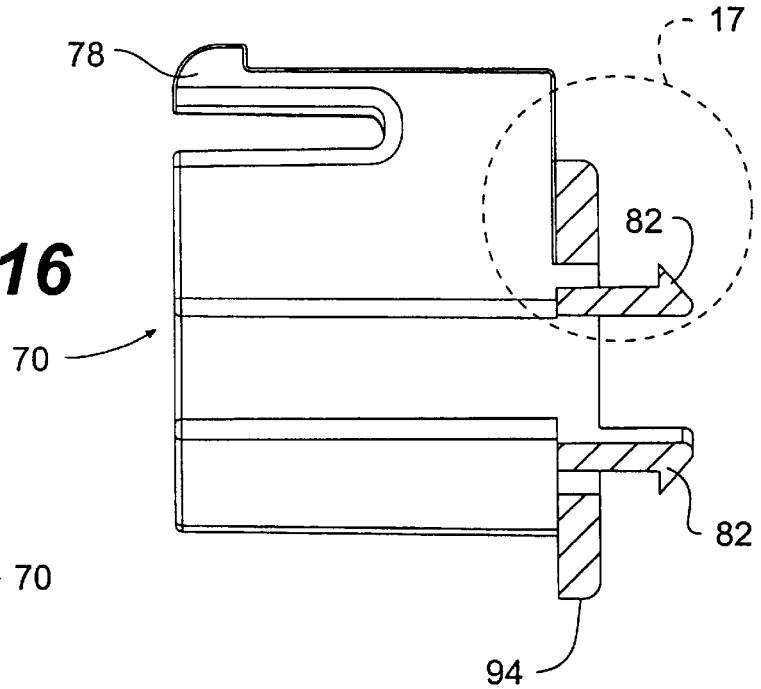
FIG. 16 is a cross-sectional view of the first lever portion taken generally along line 16—16 of FIG. 15.
Figure 17:
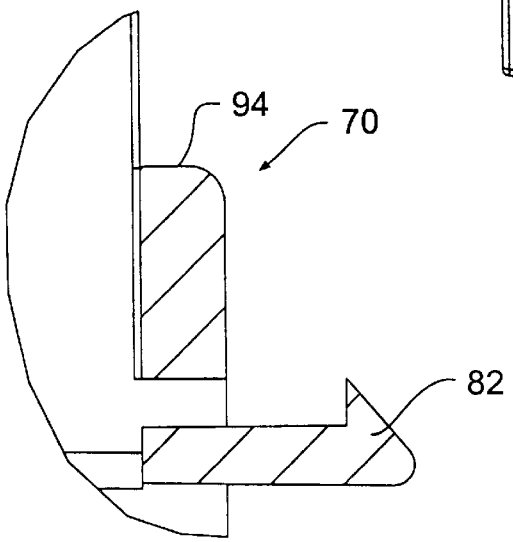
FIG. 17 is an enlarged partial view of the first lever portion taken generally within region 17 of FIG. 16.
Figure 18:
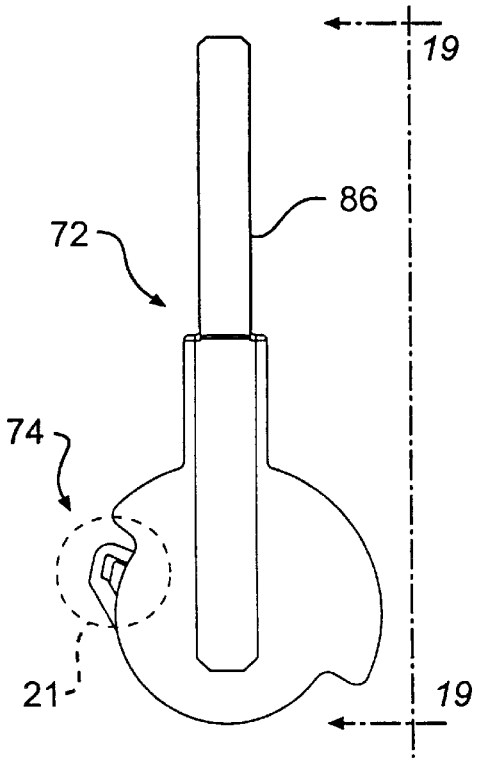
FIG. 18 is an enlarged side view of a second lever portion which is part of the tap assembly of FIGS. 4–5.
Figure 19:
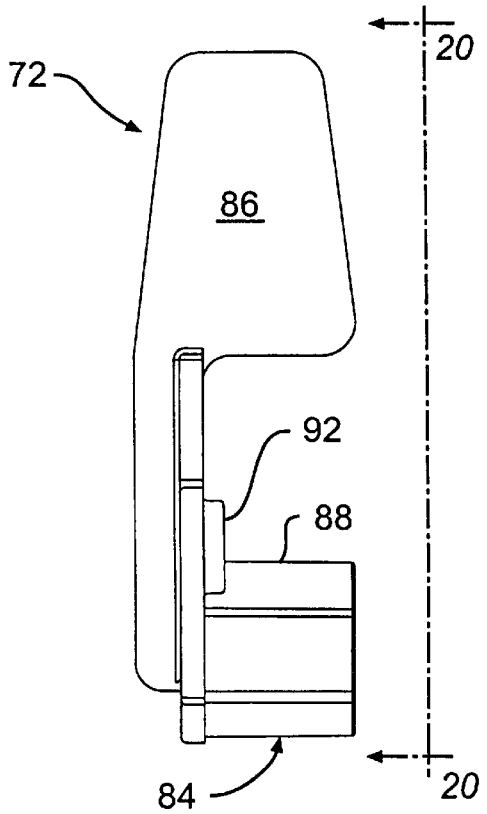
FIG. 19 is another side view of the second lever portion taken generally along line 19—19 of FIG. 18.
Figure 20:
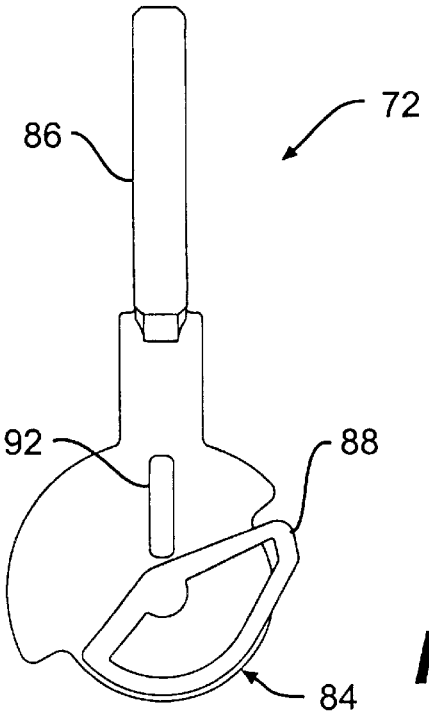
FIG. 20 is an opposite side view of the second lever portion taken generally along line 20—20 of FIG. 19.
Figure 21:
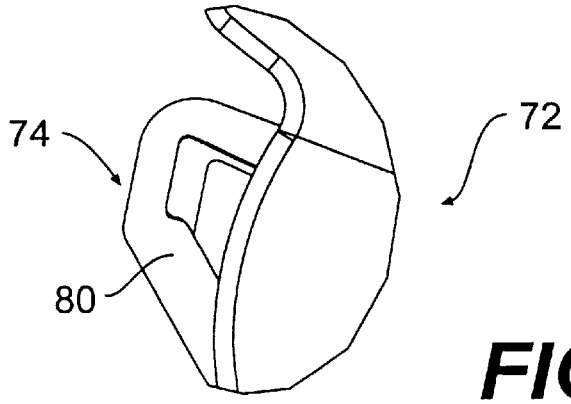
FIG. 21 is an enlarged partial view of the second lever portion taken generally within region 21 of FIG. 18.

The tap 22 is preferably molded from a thermoplastic material such as polypropylene with about 20% talc. As shown in FIGS. 4 and 6–11, the tap 22 includes a cavity 40, a chamber 42, a first stop 44, and a second stop 46. As shown in FIGS. 57–58, the delivery tube 20 is positioned in the tap cavity 40. The inlet 34 of the delivery tube is connected to the diffuser assembly 28 by, for example, an interference fit. The outlet 36 of the delivery tube is arranged to communicate liquid outside the tap 22 through a front opening 50 of the tap cavity 40. As shown in FIGS. 7 and 10, the tap cavity 40 defines a cylindrical bore 52, an internally semi-cylindrical bearing surface 54, at least one aiming brace 56, and at least one protrusion 58. Referring to FIG. 58, the delivery tube 20 is positioned against to the aiming brace 56 near its outlet 36 to accurately direct the flow of dispensed liquid through the front opening 50 of the tap 22. The resilient flow control portion 38 of the delivery tube 20 is positioned adjacent to the relatively-rigid protrusion 58 of the tap cavity 40. The tap chamber 42 has a gas inlet 60 and a gas outlet 62. The gas inlet 60 of the tap 22 is adapted to be in fluid communication with the manifold assembly 32. The gas outlet 62 of the tap 22 is adapted to be in fluid communication with the source 12 of liquid. The tap 22 has an internal helical thread 64 (FIG. 10) which is adapted to be removably connected to a matable external helical thread 66 (FIG. 56) formed on the outlet of the container 18. The annular tap seal 24 (FIGS. 4 and 58) is provided as a fluid seal adjacent the threaded connection between the tap 22 and the container 18.

Figure 22:
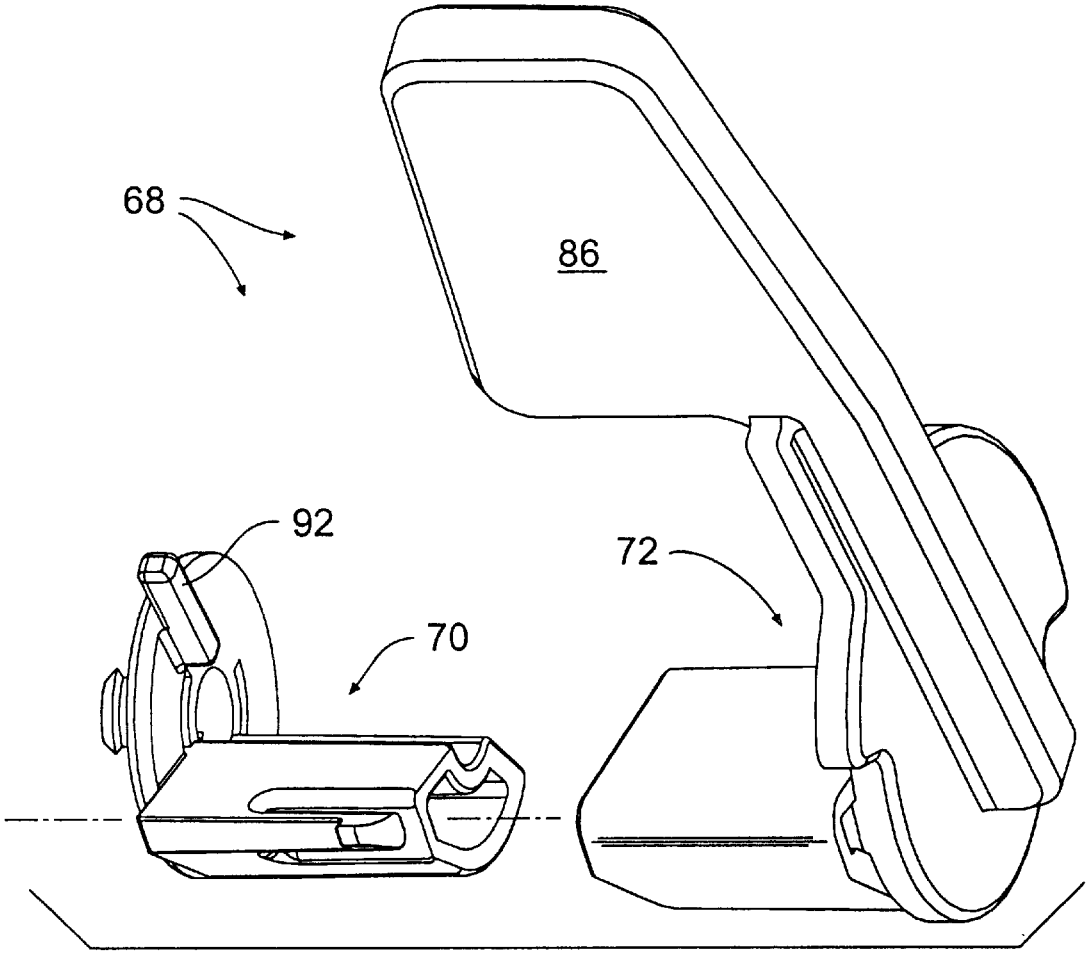
FIG. 22 is an exploded perspective view of the first and second lever portions forming a lever assembly which is part of the tap assembly of FIGS. 4–5.
Figure 24:
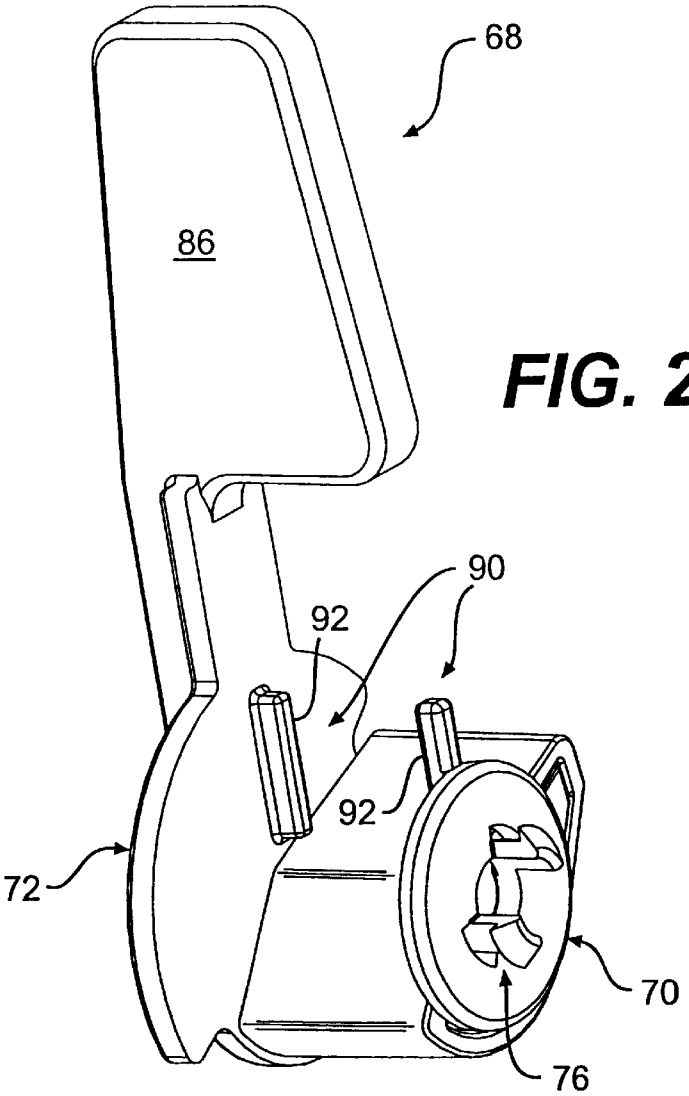
FIG. 24 is another perspective view of the lever assembly of FIG. 23.
Figure 23:
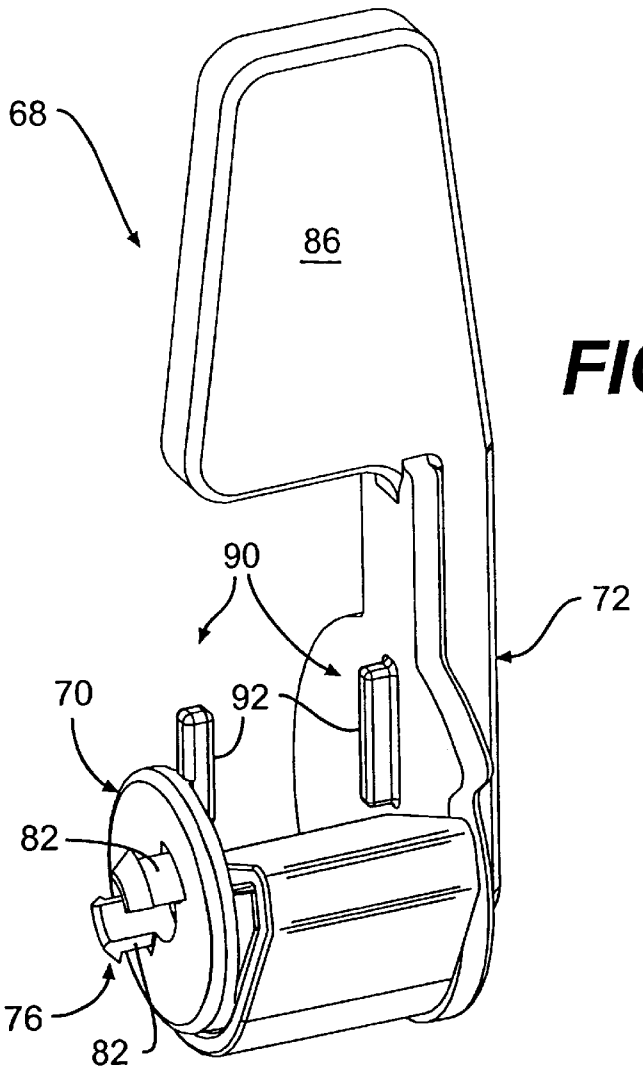
FIG. 23 is an enlarged perspective view of the lever assembly of FIG. 4 but shown from a different perspective.
Figure 56:
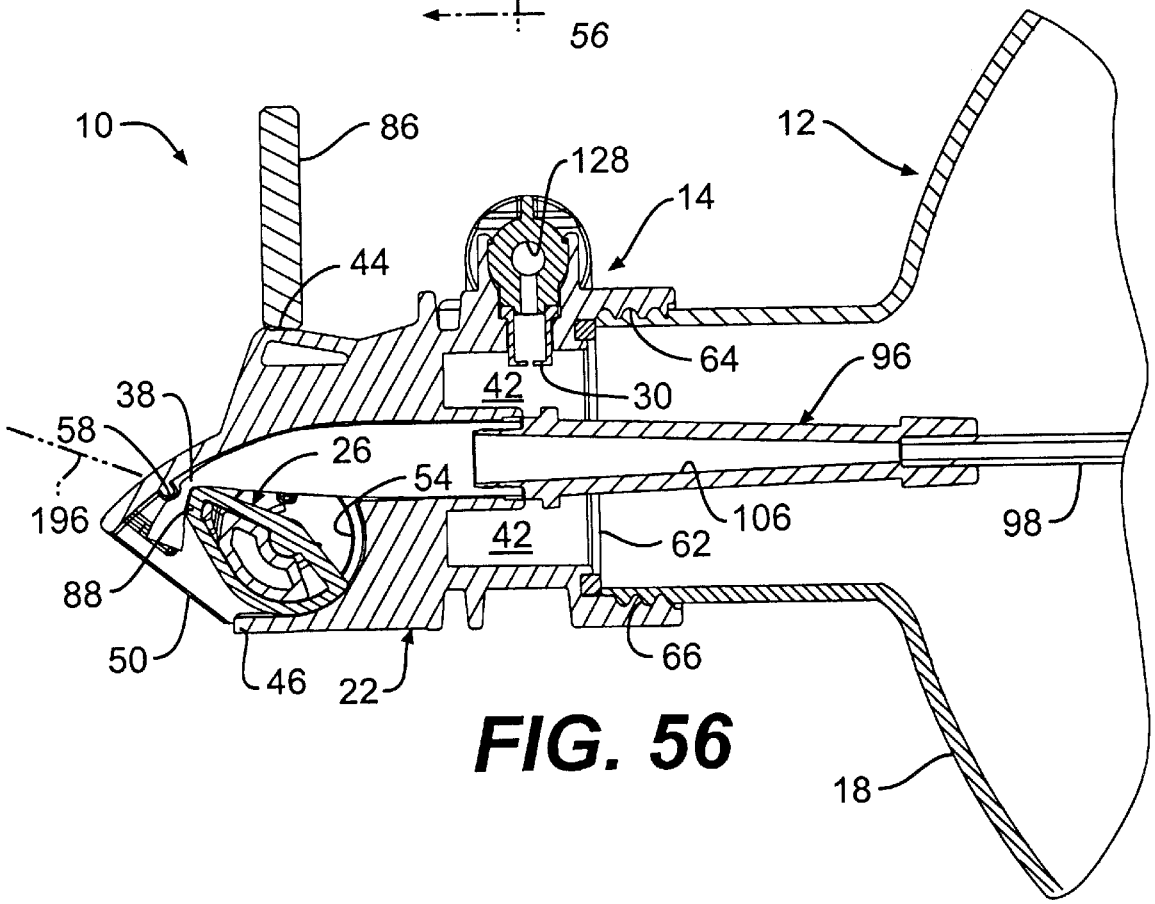
FIG. 56 is a cross-sectional partial view of the liquid dispenser taken generally along line 56—56 of FIG. 55.

As shown in FIGS. 56 and 58, the control valve means 26 is provided for selectively compressing or not compressing the resilient flow control portion 38 of the delivery tube 20. Referring to FIGS. 22–24, the control valve means 26 preferably includes a lever assembly 68 having a first lever portion 70 and a second lever portion 72. Both the first and second lever portions 70,72 are preferably molded from a thermoplastic material such as polypropylene with about 20% talc. As shown in FIGS. 12–17, the first lever portion 70 includes a first latching means 74 and a second latching means 76. The first latching means 74 is provided for connecting the first lever portion 70 to the second lever portion 72. Referring to FIG. 4, the first lever portion 70 telescopically connects within a cavity 77 of the second lever portion and is retained together by the first latching means 74. As shown for example in FIGS. 12 and 16, the first latching means may include a hook 78, integrally formed on the first lever portion 70, which attaches to a matable eyelet 80 formed on the second lever portion 72. Alternatively, the lever assembly 68 may be formed as a single piece. The second latching means 76 is provided for connecting the lever assembly 68 to the tap 22. The second latching means 76 may include a pair of spaced-apart prongs 82 (FIGS. 16–17) integrally formed on the first lever portion 70. During assembly of the lever assembly 68 to the tap 22, the prongs 82 extend through the bore 52 and radially outwardly snap against the tap 22 for retention thereto as shown in FIG. 26.

Figure 59:
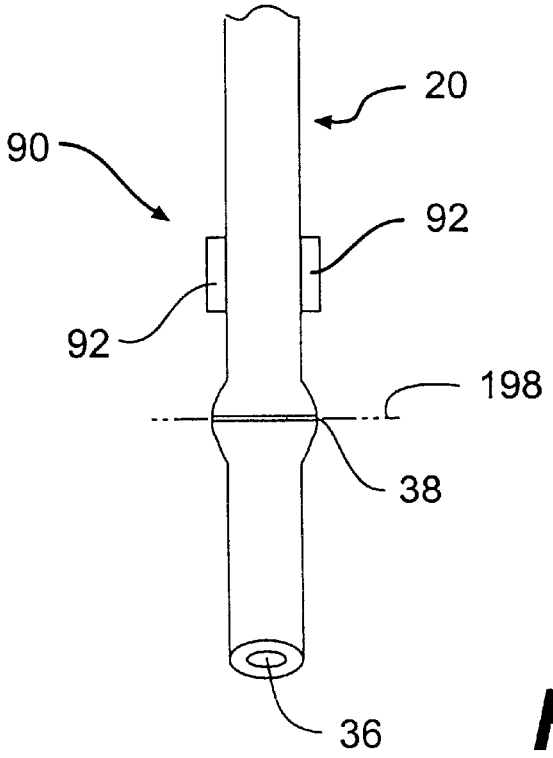
FIG. 59 is a partial view of the fluid delivery tube and a decompression means, which correspond to the liquid dispenser of FIGS. 55–56, wherein the decompression means is shown at its closed-liquid-flow position.

Referring to FIGS. 18–21, the second lever portion 72 includes an integrally-formed cam 84 and a lever 86 or elongated handle. The cam 84 is rotatably positioned in the tap cavity 40. The cam 84 has an eccentric cam lobe 88 rotatably movable therewith. The chosen size of the cam lobe 88 is dependent upon the size and hardness of the resilient flow control portion 38 to be selectively squeezed with minimal physical effort. The lever 86 is connected to the cam 84 and extends outwardly from the tap 22 to be, for example, manually operated. The lever 86 is operable to move the cam lobe 88 between a first (closed) angular position shown in FIG. 56 and a second (opened) angular position shown in FIG. 58. The difference between the first and second angular positions may be, for example, about 75 degrees. At the first angular position shown in FIGS. 3 and 55–56, the lever 86 abuts the first stop 44 of the tap 22. Furthermore, the cam lobe 88 compresses the resilient flow control portion 38 against the relatively rigid protrusion 58 defined in the tap cavity 40. As shown in FIGS. 56 and 59, this well-defined line or limited area of contact effectively squeezes the flow control portion 38 flat enough to adequately seal against fluid flow therethrough. Consequently, fluid communication is positively closed between the inlet 34 and the outlet 36 of the delivery tube 20.

At the second angular position shown in FIG. 57–58, the cam lobe 88 is retracted from the resilient flow control portion 38 and abuts the second stop 46 of the tap 22. The retraction of the cam lobe 88 permits the resilient flow control portion 38 to relax or naturally expand to its uncompressed state. Consequently, fluid communication is opened between the inlet 34 and the outlet 36 of the delivery tube 20. The relatively large mechanical advantage provided by the lever 86 and cam 84 permits the use of a larger delivery tube 20, having a relatively larger cross-sectional flow area, that can still be squeezed shut with minimal physical effort. The relatively larger delivery tube 20 is advantageous for minimizing excessive foaming of liquid emanating from the outlet 36 of the delivery tube.

Figure 25:
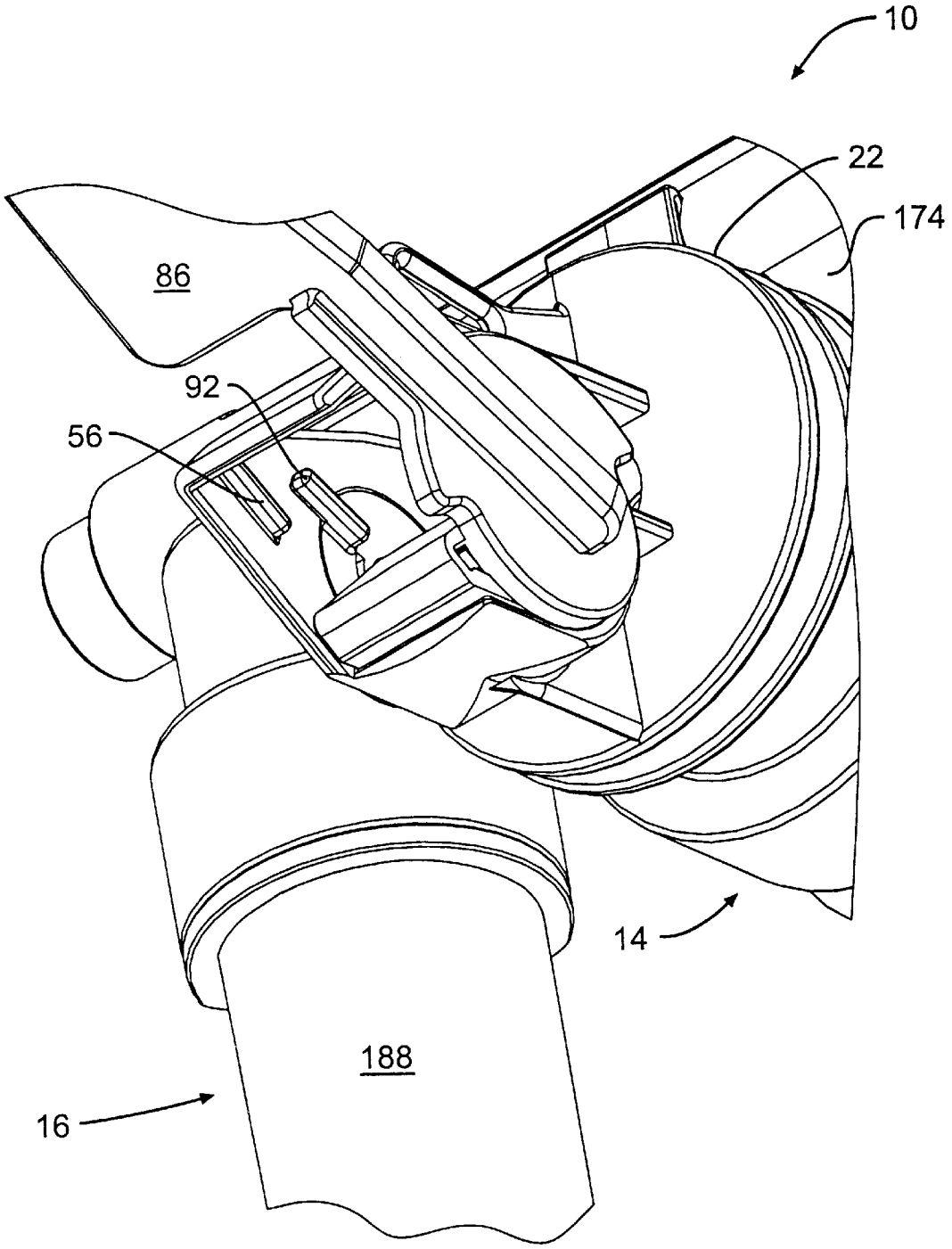
FIG. 25 is a perspective partial view of the liquid dispenser of FIG. 3 but shown from a different perspective with its liquid container and fluid delivery tube removed.
Figure 26:
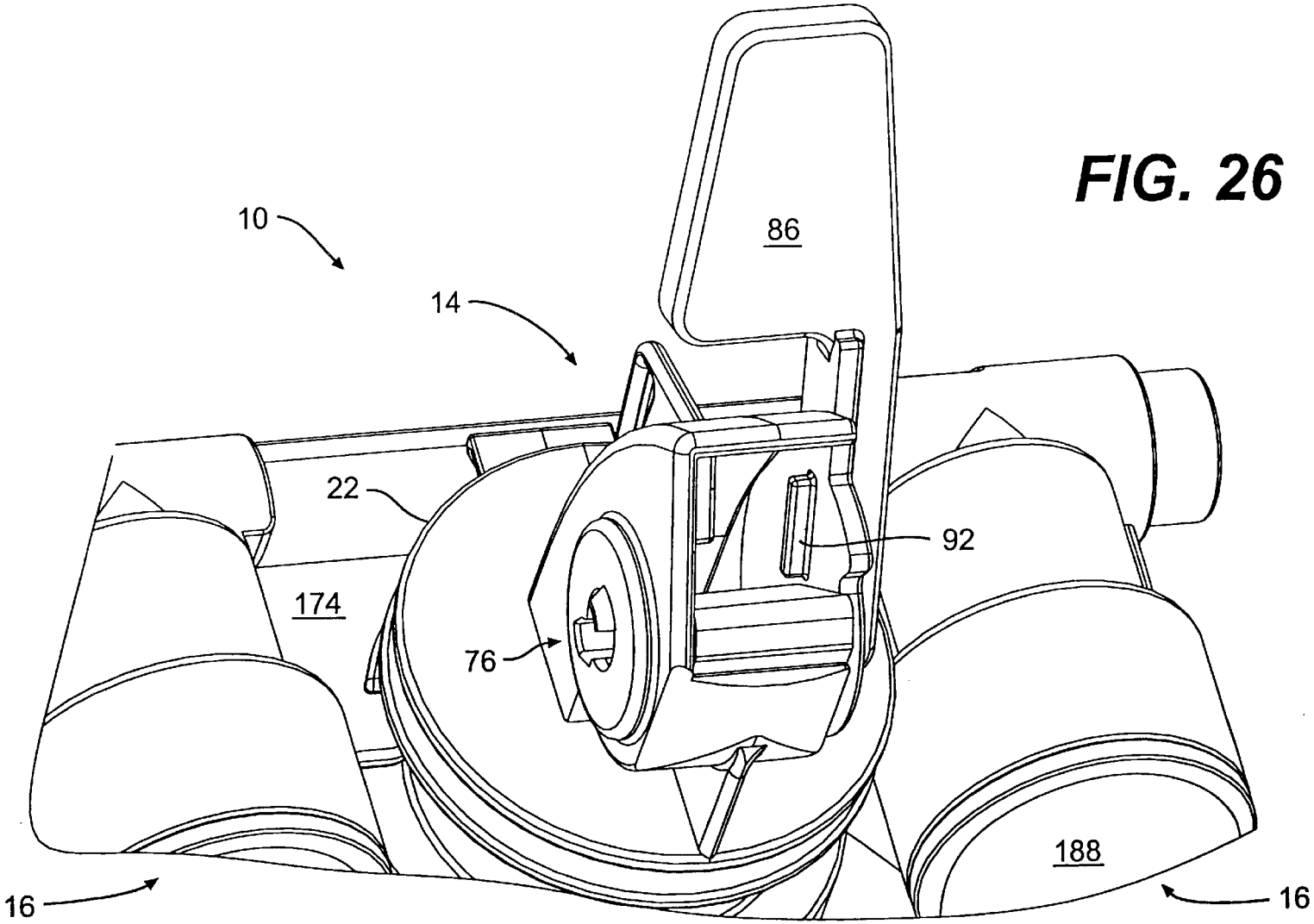
FIG. 26 is another perspective view of the liquid dispenser of FIG. 25.

As shown in FIGS. 23–26, the lever assembly 68 further includes decompression means 90 for positively ensuring decompression of the resilient flow control portion 38 of the delivery tube 20 when the cam lobe 88 is moved to and/or towards its second (opened) position. The decompression means 90 may, for example, include a pair of spaced-apart combing teeth 92 operably rotatable with the cam lobe 88. When the cam lobe 88 is at its first (closed) angular position shown in FIG. 59, the combing teeth 92 are spaced away from the flattened resilient flow control portion 38. When the cam lobe 88 is moved towards its second (opened) angular position, the combing teeth 92 angularly sweep down towards the delivery tube 20 as further indicated by FIGS. 25–26. At the second angular position shown in FIG. 60, the combing teeth 92 slidably straddle opposite sides of the resilient flow control portion 38. The combing teeth 92 are preferably spaced from one another a fixed controlled distance substantially equal to the outside diameter of the flow control portion 38 when it is in its uncompressed or natural state. For example, such spacing between the combing teeth 92 may be about 9.5 millimeters/0.375 inches. If after extended use and resultant fatigue, the flow control portion 38 is unable to naturally decompress quickly or is unable to naturally decompress at all, the combing teeth 92 will positively decompress it. The decompression means 90 is advantageously provided to readily ensure substantially unrestricted fluid communication between the inlet 34 and outlet 36 of the delivery tube 20 at the second (opened) position of the cam lobe 88. Referring to FIGS. 25–26, the lever assembly 68 is positioned in the tap cavity 40 and is rotatably supported therein by i) engagement of the prongs 82 of the first lever portion 70 with the cylindrical bore 52 (FIG. 7) of the tap 22 and ii) engagement of a cylindrical surface 94 (FIG. 16) of the first lever portion as well as the cam 84 (FIG. 56) of the second lever portion 72 with the bearing surface 54 (FIG. 7) of the tap 22.

Figure 27:
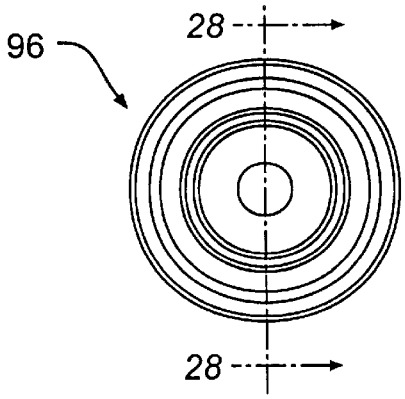
FIG. 27 is an enlarged inlet end view of a diffuser which is part of the tap assembly of FIGS. 4–5.
Figure 28:
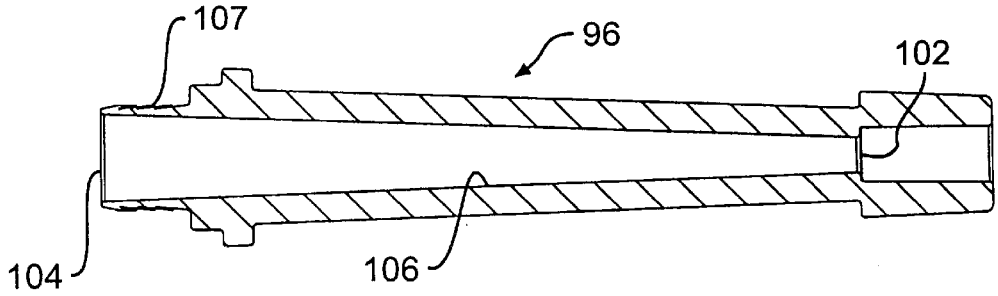
FIG. 28 is a cross-sectional view of the diffuser taken generally along line 28—28 of FIG. 27.
Figure 29:
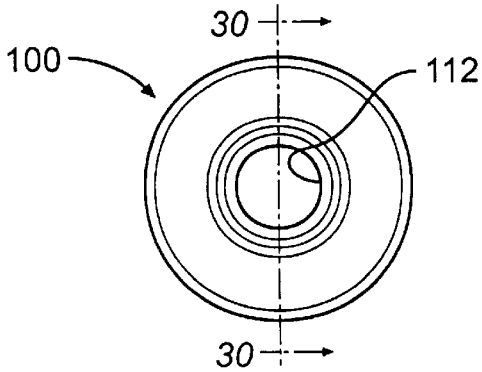
FIG. 29 is an enlarged end view of a suction tube weight which is part of the tap assembly of FIG. 4.

Referring to FIG. 4, the diffuser assembly 28 includes a diffuser 96, a suction tube 98, and a suction tube weight 100. The diffuser 96 is preferably molded from a thermoplastic material such as polypropylene with about 20% talc. As shown in FIGS. 28–27, the diffuser 96 has an inlet 102, an outlet 104, and an internal diverging passage 106 extending therebetween. As shown in FIGS. 56 and 58, the diffuser inlet 102 is adapted to be in fluid communication with the source 12 of liquid. The diffuser outlet 104 is arranged in fluid communication with the fluid delivery tube 20 but connected completely upstream of the resilient flow control portion 38.

Preferably, the diffuser outlet 104 is directly connected to the inlet 34 of the delivery tube 20. For example, the inlet 34 of the delivery tube 20 may stretch concentrically over a barbed portion 107 (FIGS. 4 and 28) formed around the diffuser outlet 104. The internal passage 106 has an inside diameter which diverges from the diffuser inlet 102 to the diffuser outlet 104. The internal diameter is sized to help effect laminar flow of pressurized liquid exiting the container 18 and to reduce its velocity so as to minimize excessive foaming. The desired length of the internal diverging passage 106 and relative diameters of the diffuser inlet 102 and diffuser outlet 104 depend upon the type of liquid being dispensed as well as its temperature and pressure. For example, for dispensing carbonated beer at the rate of about 20.8 milliliters/0.70 fluid ounces per second, the inside diameter of the diffuser inlet 102 may be about 2.5 millimeters/0.10 inches, the inside diameter of the diffuser outlet 104 may be about 6.4 millimeters/0.25 inches, and the length of the internal diverging passage 106 may be about 54 millimeters/2.125 inches. This exemplary flowrate is roughly equivalent to filling about a 250 milliliter/8.46 fluid ounce glass with beer from the liquid dispenser 10 in about twelve seconds.

Figure 30:
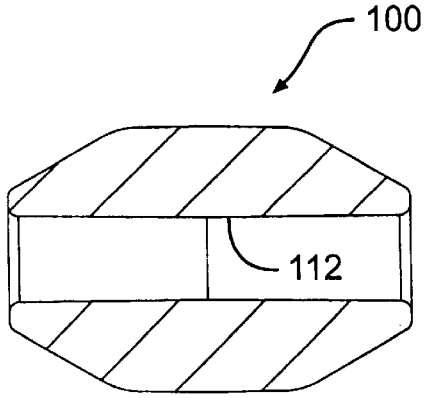
FIG. 30 is a cross-sectional view of the suction tube weight taken generally along line 30—30 of FIG. 29.
Figure 31:
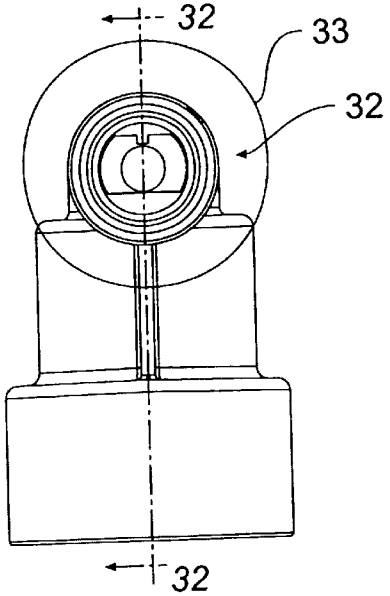
FIG. 31 is an enlarged side view of a manifold which is part of the tap assembly of FIGS. 4–5.
Figure 34:
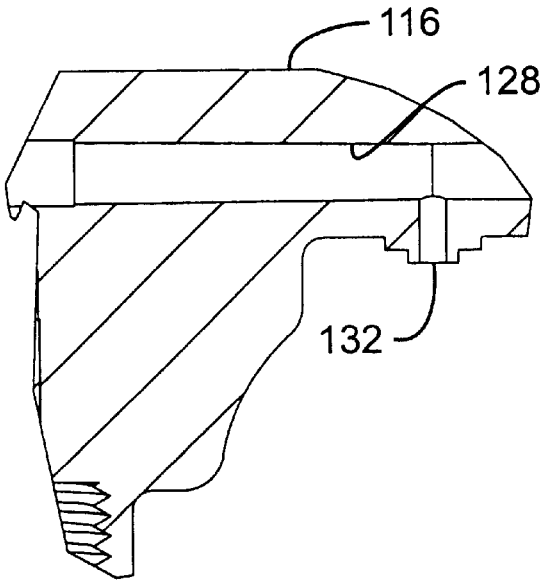
FIG. 34 is an enlarged partial view of the manifold taken generally within region 34 of FIG. 32.
Figure 35:
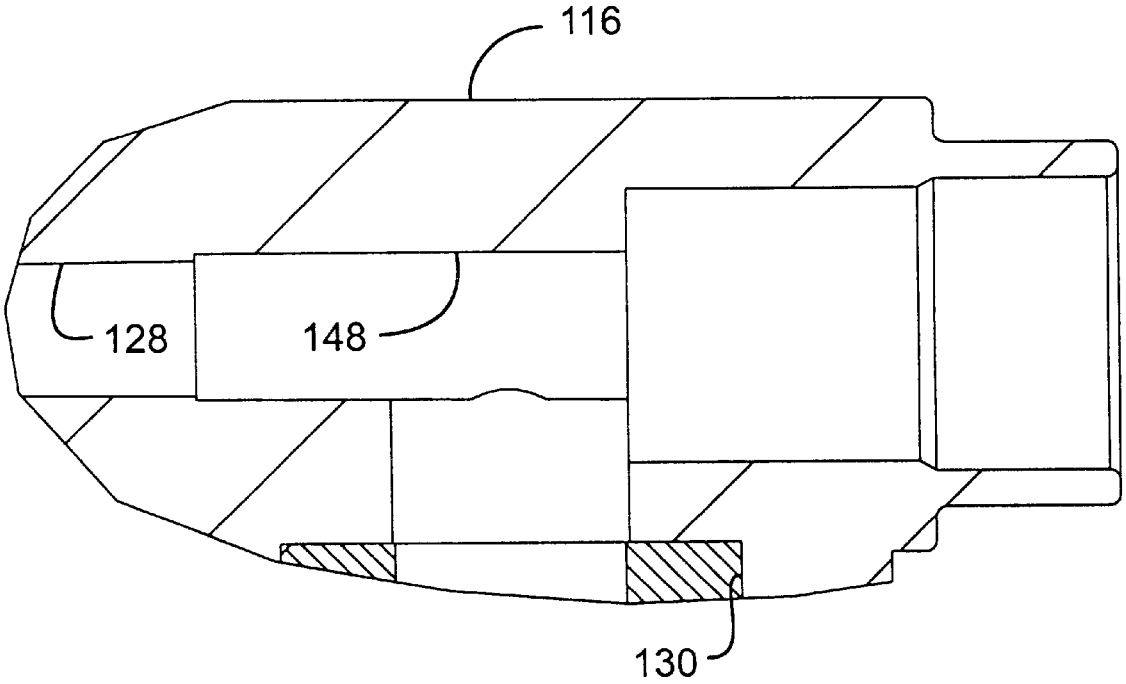
FIG. 35 is an enlarged partial view of the manifold taken generally within region 35 of FIG. 32.

The suction tube 98 has an inlet 108 and an outlet 110. The outlet 110 is connected to the diffuser inlet 102, preferably by an interference fit. The inlet 108 of the suction tube 98 is adapted to be inserted within the liquid container 18. The suction tube 98 may, for example, be about 178 millimeters/7 inches long and have an inside diameter of about 2.3 millimeters/0.090 inches. The weight 100 is preferably molded from a thermoplastic material such as polypropylene with about 20% talc. The weight 100, shown in FIGS. 30–31, defines an axial bore 112 through which the suction tube 98 is connected at or near its inlet 108, preferably by an interference fit. The weight 100 advantageously helps ensure that the suction tube inlet 108 remains at the bottom of the container 18 for communicating with substantially all liquid remaining in the container. Alternatively, the diffuser assembly 28 may be formed as a single piece.

As shown in FIGS. 4, 56, and 58, the check valve means 30 is provided for permitting gas flow from the manifold assembly 32 to the tap chamber 42 and for blocking liquid flow in the reverse direction. The check valve means 30 preferably includes a one-way check valve, such as a duck bill valve. The duck bill is arranged to snap into a seat 114 (FIG. 9) of the tap 22.

As shown in FIGS. 4 and 31–37, the manifold assembly 32 preferably includes a manifold 116. For each source 16 of pressurized gas, the manifold assembly 32 also includes a high-strength insert 118, a regulator seat assembly 120, a retainer nut 122, a regulator piston assembly 124, and a manifold plug (not shown).

The manifold 116 is preferably molded from a thermoplastic material such as polypropylene with about 20% talc. Referring to FIGS. 31–35, the manifold 116 defines an internal common rail passage 128 and a plurality of internal branch inlets 130 separately connected to the common rail passage. The common rail passage 128 has a single gas outlet 132. The check valve means 30 is positioned between the gas outlet 132 of the manifold 116 and the gas inlet 60 of the tap 22. Each branch inlet 130 is adapted to be in selective fluid communication with its respective source 16 of pressurized gas. In the embodiment shown, the manifold 116 has a pair of spaced-apart branch inlets 130.

The high-strength cylindrical insert 118 is provided to withstand high gas pressures emanating from the source 16 of pressurized gas before such high pressures are reduced or stepped down to a relatively low pressure within the manifold 116. For example, the insert 118 may be made of a high-strength metal or high-strength polymer. This advantageously helps reduce the overall cost of the manifold 116 which can be made of a relatively-lower-cost material such as the material already described above. Alternatively, the manifold assembly 32 may be formed as a single piece of high-strength material.

Figure 38:
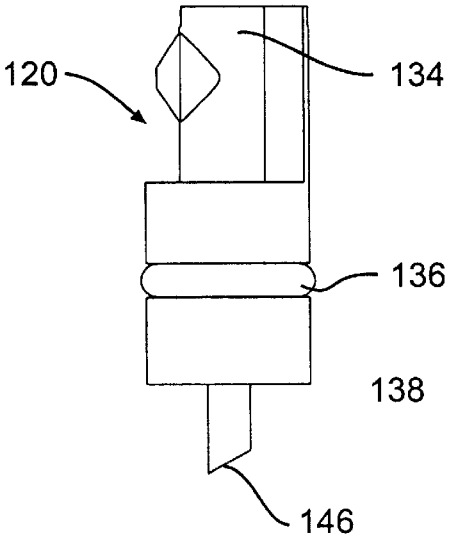
FIG. 38 is an enlarged side view of a regulator seat assembly which is part of the liquid dispenser of FIG. 36.
Figure 39:
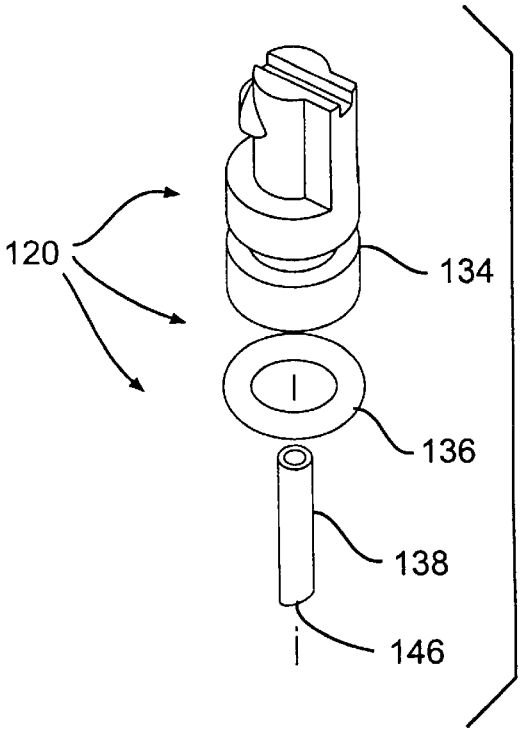
FIG. 39 is an exploded perspective view of the regulator seat assembly of FIG. 38.
Figure 40:
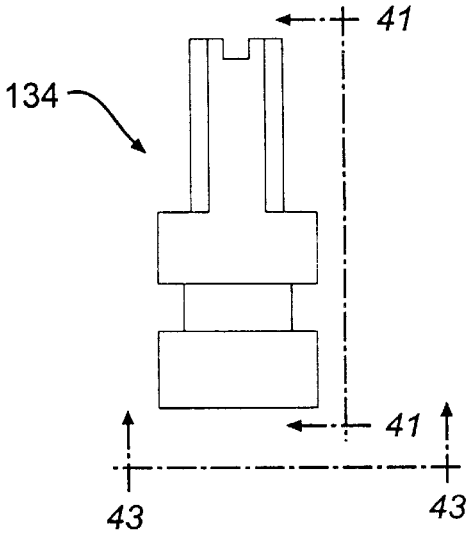
FIG. 40 is a side view of a regulator body which is part of the regulator seat assembly of FIGS. 38–39.
Figure 41:
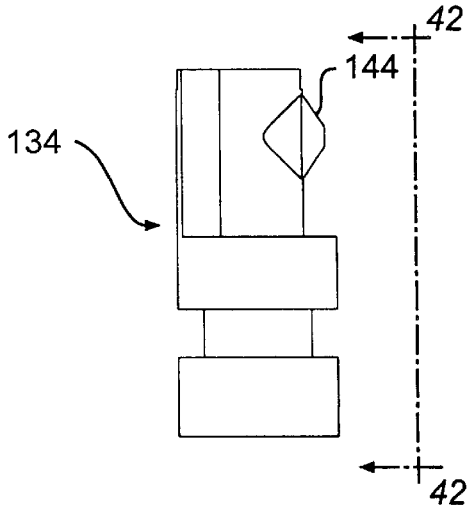
FIG. 41 is another side view of the regulator body taken generally along line 41—41 of FIG. 40.
Figure 42:
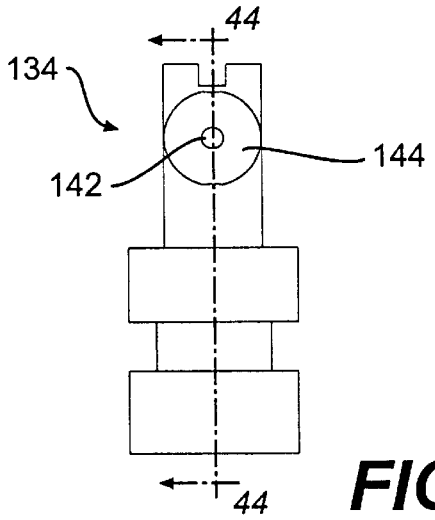
FIG. 42 is an opposite side view of the regulator body taken generally along line 42—42 of FIG. 41.
Figure 43:
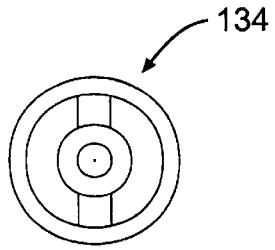
FIG. 43 is a bottom end view of the regulator body taken generally along line 43—43 of FIG. 40.
Figure 44:
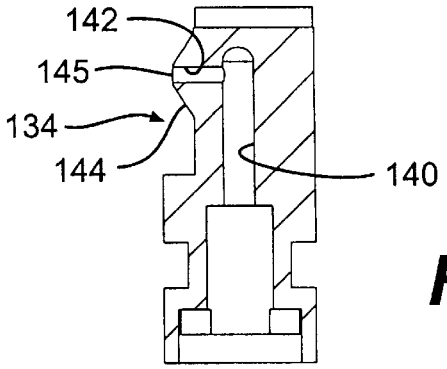
FIG. 44 is a cross-sectional view of the regulator body taken generally along line 44—44 of FIG. 42.

As shown in FIGS. 38–39, the regulator seat assembly 120 includes a regulator body 134, an o-ring seal 136, and a tubular piercer or hollow needle 138. The regulator body 134 is molded from a material having the desirable properties of high impact strength, high tensile strength, low shrink value, and good resistance against chemical degradation, over a wide temperature range. Preferably, such material is formed from an acetal such as Delrin or the like. As shown in FIGS. 40–44, the regulator body 134 includes a central axial passage 140 communicating with the piercer 138, a radially-extending restricted passage 142 communicating with the axial passage 140, and an annular seat 144 defining an outlet 145 of the restricted passage. The cross-sectional area and length of the restricted passage 142 are sized to reduce or step down the pressure of the source 16 of pressurized gas to a desired level. For example, the inside diameter of the restricted passage 142 may be about 0.81 millimeters/0.032 inches and the length of the restricted passage may be about 3.18 millimeters/0.125 inches.

The piercer 138 is preferably formed from a high-strength metal and includes a relatively sharp beveled end 146. The piercer 138 is connected to the regulator body 134, preferably by a press fit. The retainer nut 122 is preferably molded from a thermoplastic material such as polypropylene with about 20% talc. One regulator seat assembly 120 is positioned in each of the branch inlets 130 of the manifold 116, followed by the insert 188 which slip fits around the regulator seat assembly 120, followed by the retainer nut 122 which is threadably connected to a matable socket 147 formed in the branch inlet 130.

Figure 32:
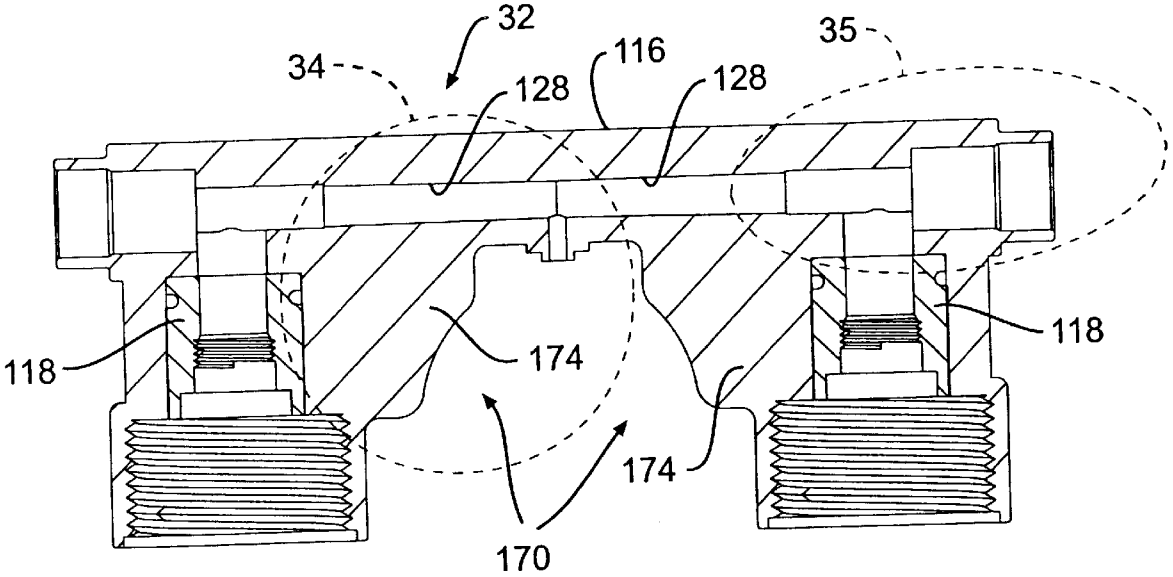
FIG. 32 is a cross-sectional view of the manifold taken generally along line 32—32 of FIG. 31.
Figure 33:
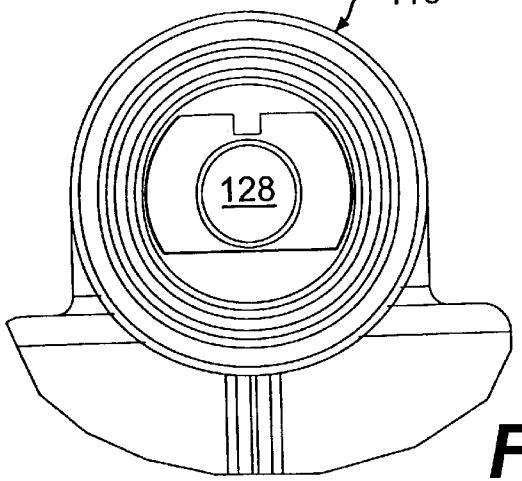
FIG. 33 is an enlarged partial view of the manifold taken generally within region 33 of FIG. 31.
Figure 36:
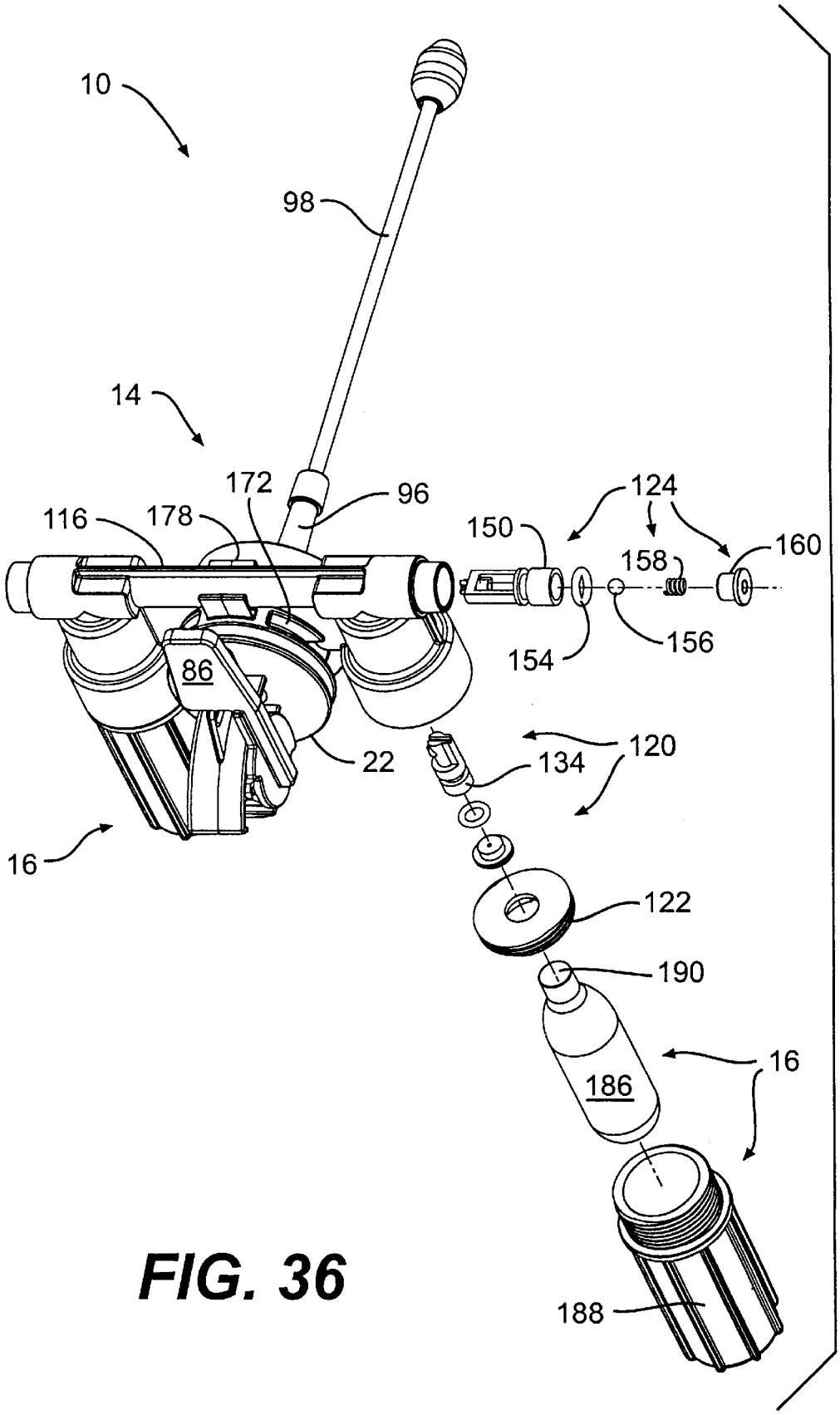
FIG. 36 is an enlarged and partially-exploded perspective partial view of the liquid dispenser of FIGS. 1–3 but shown from a different perspective in its closed-liquid-flow position with its liquid container removed.
Figure 37:
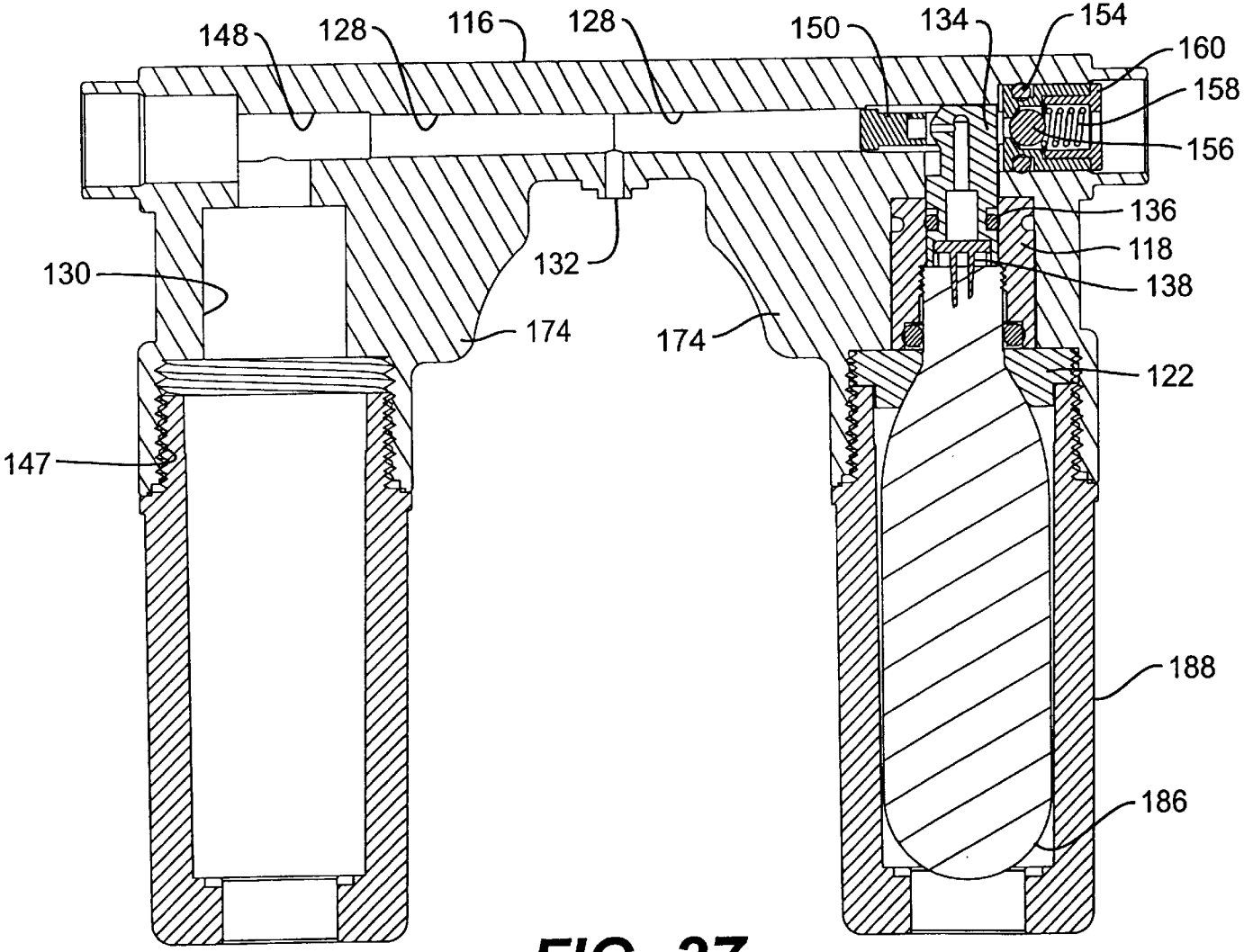
FIG. 37 is an enlarged cross-sectional view of the manifold assembled with some of the other internal components of the liquid dispenser of FIG. 36.
Figure 45:
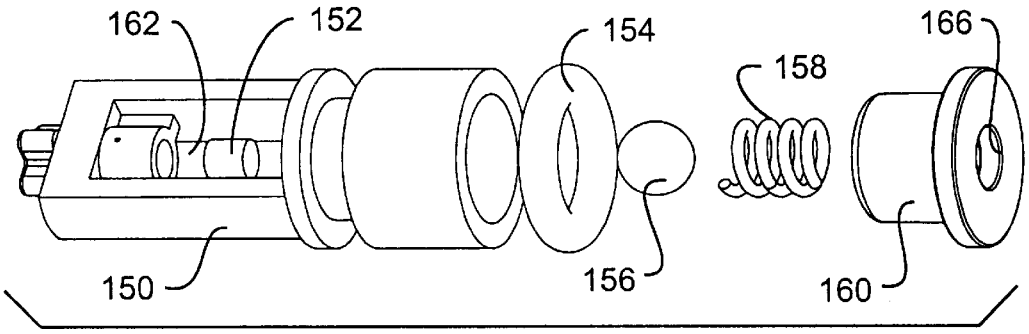
FIG. 45 is an enlarged exploded perspective view of a regulator piston assembly which is part of the liquid dispenser of FIG. 36.
Figure 46:
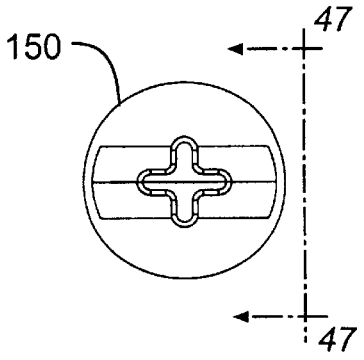
FIG. 46 is an end view of a regulator housing which is part of the regulator piston assembly of FIG. 45.
Figure 47:
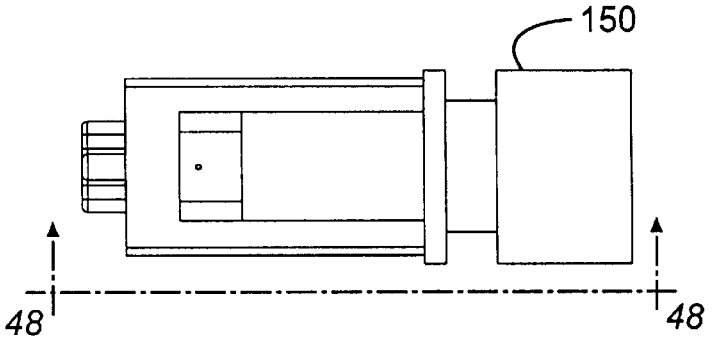
FIG. 47 is a side view of the regulator housing taken generally along line 47—47 of FIG. 46.
Figure 48:
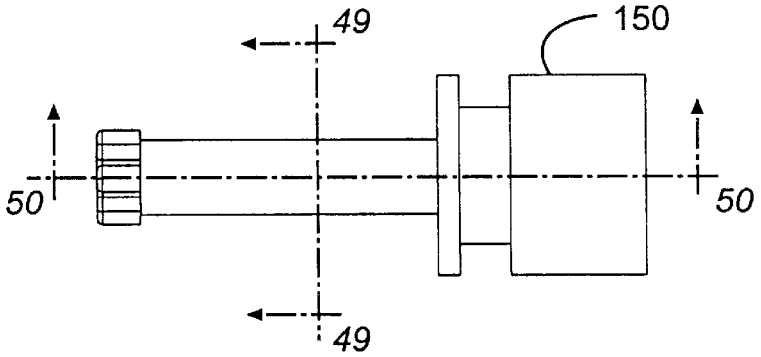
FIG. 48 is a another side view of the regulator housing taken generally along line 48—48 of FIG. 47.
Figure 49:
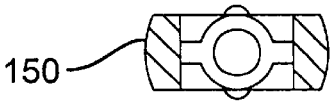
FIG. 49 is a cross-sectional view of the regulator housing taken generally along line 49—49 of FIG. 48.

One regulator piston assembly 124 is provided for each branch inlet 130 of the manifold 116. As shown in FIGS. 32 and 36–37, the regulator piston assembly 124 is positioned in a respective counterbore 148 of the common rail passage 128 of the manifold 116. Referring to FIG. 45, the regulator piston assembly 124 includes a regulator housing 150, a movable regulator piston 152, an o-ring seal 154, a regulator piston ball 156, a return spring 158, and a regulator piston cover 160. The regulator piston assembly 124 is provided to maintain the container 18, as well as the common rail passage 128 of the manifold 116, at a desired gas pressure level.

The regulator housing 150 is preferably molded from a material such as Delrin or the like. The regulator piston 152 can be molded from a non-porous slidable elastomeric material which deforms somewhat under pressure to provide good sealing characteristics. Preferably, the elastomeric material is formed from ethylene propylene or the like.

The regulator piston 152 is preferably formed as a solid cylindrical piece. The regulator piston 152 is operable to reciprocally move, within a confined chamber or cage 162 of the regulator housing 150, between an unseated position and a seated position. The chamber 162 of the regulator housing 150 is arranged in fluid communication with the common rail passage 128 of the manifold 116.

The movable regulator piston 152 has an effective cross-sectional area which is much greater than the cross-sectional area of the restricted passage 142 of the regulator body 134. For example, the diameter of the regulator piston 152 may be about 2.2 millimeters/0.0860 inches while the diameter of the restricted passage 142 may be about 0.81 millimeters/0.032 inches. The ratio of these areas is such that the regulator piston 152 is moved to its unseated position when the force of the reduced gas pressure acting on the regulator piston 152 is greater than the opposing force of the manifold gas pressure acting on the regulator piston. At its unseated position, the regulator piston 152 is spaced away from the annular seat 144 of the regulator body 134 thereby unblocking the restricted passage outlet 145. Thus, fluid communication is opened between the restricted passage 142 and the chamber 162 of the regulator housing 150.

The regulator piston 152 is moved to its seated position when the force of the reduced gas pressure acting on the regulator piston is less than the opposing force of the manifold gas pressure acting on the regulator piston. At its seated position, the regulator piston 152 abuts the annular seat 144 of the regulator body 134 thereby blocking the restricted passage outlet 145 and closing fluid communication between the restricted passage 142 and the chamber 162 of the regulator housing 150.

Figure 50:
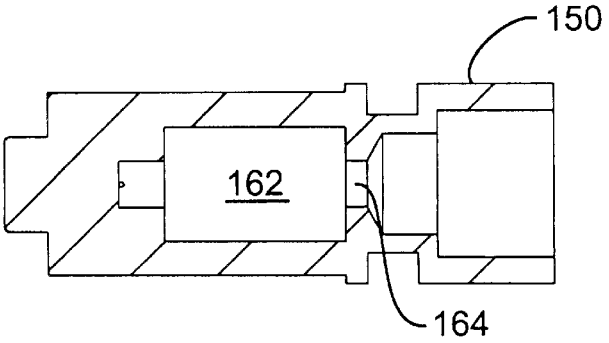
FIG. 50 is a cross-sectional view of the regulator housing taken generally along line 50—50 of FIG. 48.
Figure 51:
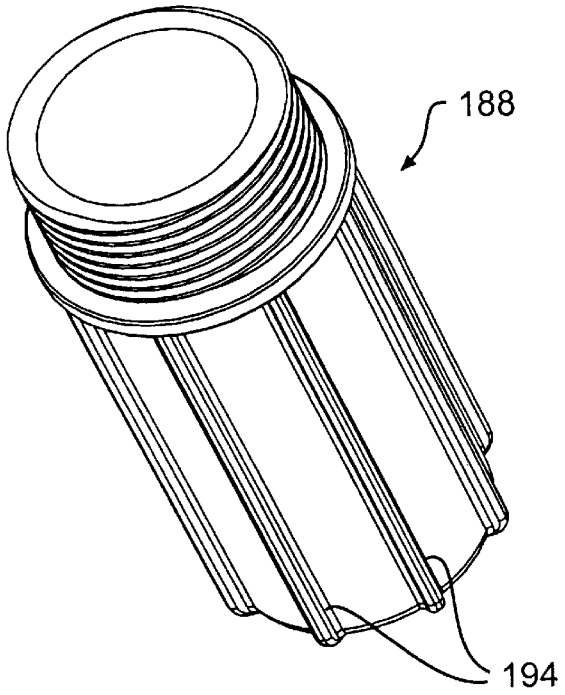
FIG. 51 is an enlarged perspective and more detailed view of a compressed-gas-cartridge holder which is part of the liquid dispenser of FIG. 36.
Figure 52:
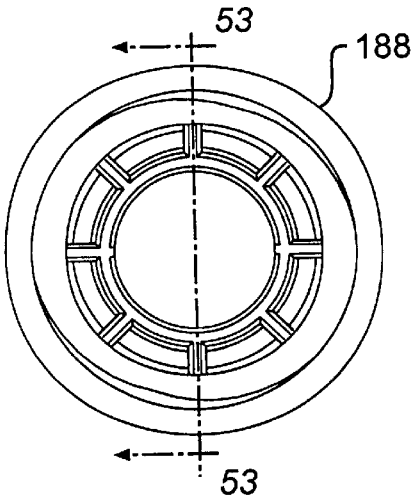
FIG. 52 is a top end view of the compressed-gas-cartridge holder of FIG. 51.
Figure 53:
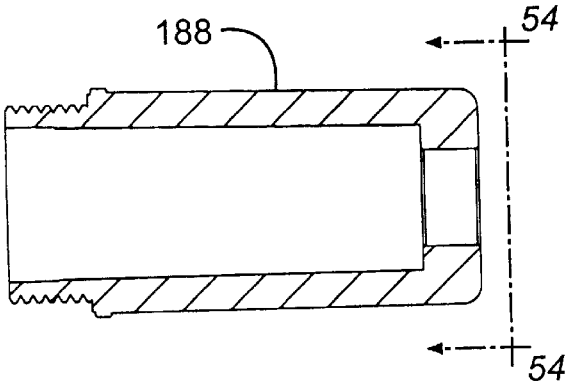
FIG. 53 is a cross-sectional view of the compressed-gas-cartridge holder taken generally along line 53—53 of FIG. 52.
Figure 54:
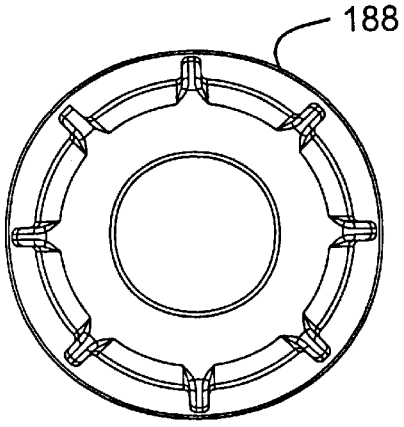
FIG. 54 is a bottom end view of the whole compressed-gas-cartridge holder taken generally along line 54—54 of FIG. 53.

The return spring 158 biases the regulator piston ball 156 against a vent opening 164 (FIGS. 37 and 50) formed in the regulator housing 150. The regulator piston cover 160 is preferably molded from a material such as Delrin. The regulator piston cover 160 includes a vent passage 166. The regulator piston cover 160 is connected to the regulator housing 150, preferably by a press fit.

The manifold plug (not shown) is shaped similar to the regulator piston cover 160 although somewhat larger. The manifold plug is preferably molded from a thermoplastic material such as polypropylene with about 20% talc. The manifold plug includes a vent passage, similar to vent passage 166, which communicates with both the vent passage 166 of regulator piston cover 160 and ambient air. Following assembly of the regulator piston assembly 124 to the manifold 116, the manifold plug is connected to the counterbore 148 of the manifold 116, preferably by a press fit. When the regulator piston ball 156 is unseated from the vent opening 164, the chamber 162 of the regulator housing 150 is adapted to communicate with ambient air through the vent passages of the regulator piston cover and manifold plug.

As shown in FIG. 4, the tap assembly 14 further includes piloting means or members 170 for accurately guiding the manifold 116 and tap 22 into a unique and stable alignment with one another during subassembly thereof. Referring to FIGS. 7 and 32, the piloting means 170 includes, for example, at least a pair of spaced-apart flanges 172 extending from the tap 22 and at least one planar guide 174 extending from the manifold 116. In the embodiment illustrated, there are two flanges 172 and two guides 174. The pair of flanges 172 define at least one, but preferably, two peripheral slots 176 therebetween. As shown in FIG. 3 and 25–26, each guide 174 of the manifold 116 is slidably positioned in a respective slot 176 of the tap 22. The piloting means 170 advantageously facilitates quick and fool-proof assembly of the manifold 116 to the tap 22.

Figure 5:
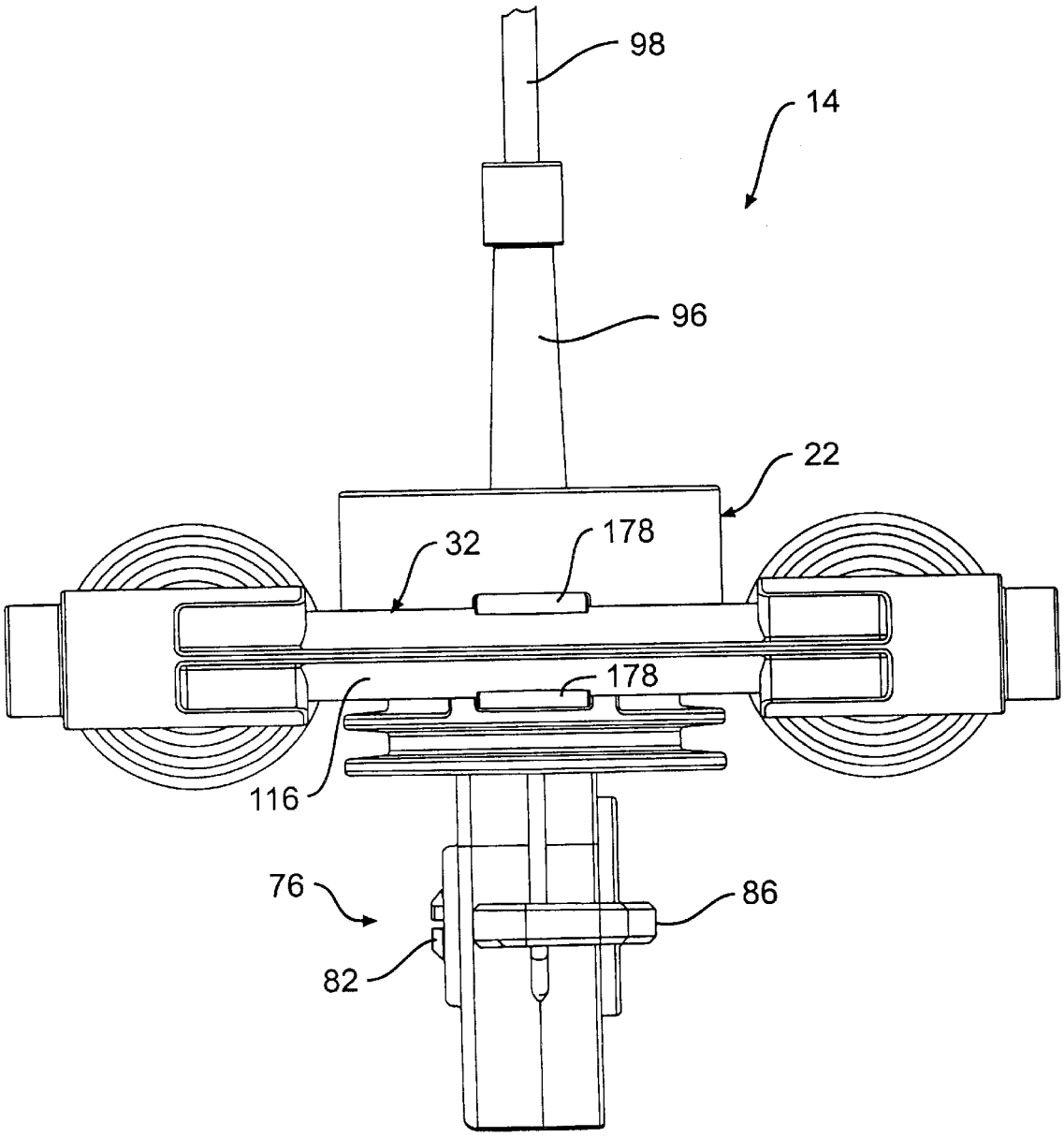
FIG. 5 is an enlarged top plan partial view of the tap assembly of FIG. 4 but shown in its assembled state.
Figure 6:
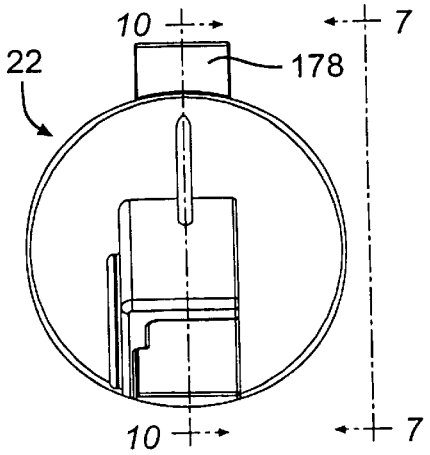
FIG. 6 is an enlarged outlet end view of a tap which is part of the tap assembly of FIGS. 4–5.

Either the tap 22 or the manifold 116 further includes a pair of spaced-apart integrally-formed elastic clips 178 extending therefrom. The other of the tap 22 and the manifold 116 includes a pair of spaced-apart integrally-formed clip holders 180. In the embodiment shown in FIG. 4 and 11, the clip holders 180 are integrally formed on opposite sides of the manifold 116 and the clips 178 are integrally formed on the top of the tap 22. As shown in FIGS. 3 and 5, the manifold 116 is removably retained to the tap 22 by a snap fit of each elastic clip 178 with its respective matable clip holder 180. The clips 178 have oppositely-facing support surfaces 182 which conform to an outer peripheral surface portion 184 of the manifold 116 for matable contact therewith. In the embodiment shown, the support surfaces 182 of the clips 178 are shaped concave and the outer peripheral surface portion 184 of the manifold 116 is shaped convex. This arrangement of additional matable surfaces advantageously provides additional rigid support between the subassembled manifold 116 and tap 22.

In the embodiment shown in FIGS. 1 and 3, there is shown a pair of refillable sources 16 of pressurized gas. Referring to FIGS. 36–37, each source 16 of pressurized gas include a conventional compressed gas cartridge 186 and a compressed-gas-cartridge holder 188. Each cartridge 186 contains a pressurized gas such as carbon dioxide gas ($CO_2$) or nitrogen gas ($N_2$) which is originally sealed in the cartridge 186 by a high pressure gasket 190. The holder 188 is preferably molded from a thermoplastic material such as polypropylene with about 20% talc. As shown in FIG. 36, the holder 188 envelopes the respective cartridge 186 and is threadably fastened to the respective matable socket 147 of each branch inlet 130 of the manifold 116. As shown in FIGS. 51–54, the holder 188 preferably includes a plurality of circumferentially-spaced longitudinally-extending ribs 194. The ribs 194 facilitate easy manual gripping for attachment and removal of the holder 188 and the cartridge 186 relative to the manifold 116.

INDUSTRIAL APPLICABILITY

The subject invention will now be described as adapted for a liquid dispenser 10 of pressurized beverage. The unique arrangement of a plurality of pressurized gas cartridges 186 connected to the manifold 116 has many advantages over a single gas cartridge of similar overall capacity. One advantage is the relatively lower cost of obtaining such smaller cartridges because they are produced in much greater quantities. It also gives the user the flexibility of attaching different capacity beverage containers to the tap assembly 14 and then being able to pierce one or more gas cartridges 186 as required for such capacity.

In operation, the gas cartridge 186 is opened by screwing the respective holder 188 into its respective socket 147 of the manifold 116. This forces the cartridge gasket 190 against the sharp beveled end 146 of the piercer 138 which in turn pierces the cartridge gasket. This releases pressurized gas from the cartridge 186. The pressurized gas therein may be at a pressure of, for example, about 5.6 kiloPascals/800 pounds-force per square inch to about 11.2 kPa/1600 psi. The pressurized gas flows from the cartridge 186, through the piercer 138, through the axial passage 140 of the regulator body 134, and into the restricted passage 142.

The pressure of the gas flowing through the restricted passage 142 is reduced to a relatively-low preselected level (for example, about 0.11 kPa/15 psi). If the fluid pressure in the container 18 is of a magnitude such that the force of the manifold gas pressure acting on the regulator piston 152 is smaller than the opposing force of the reduced gas pressure acting on the regulator piston, the resultant force unseats the regulator piston away its annular seat 144. This unblocks the outlet 145 and opens fluid communication between the restricted passage 142 of the regulator body 134 and the chamber 162 of the regulator housing 150. Consequently, gas (at the reduced pressure) is allowed to flow from the pierced cartridge 186 to the common rail passage 128 of the manifold 116. The duck bill valve functions as a one-way flow valve allowing gas to flow therethrough from the common rail passage 128 to the tap cavity 40 but preventing fluid from flowing in the reverse direction. The regulator piston 152 remains unseated until the force of the manifold gas pressure acting on the regulator piston exceeds the force of the reduced gas pressure acting on the regulator piston. When that occurs, the resultant force moves the regulator piston 152 against its annular seat 144 to block the outlet 145 of the restricted passage 142. Consequently, fluid communication is blocked between the gas cartridge 186 and the manifold 116.

Figure 55:
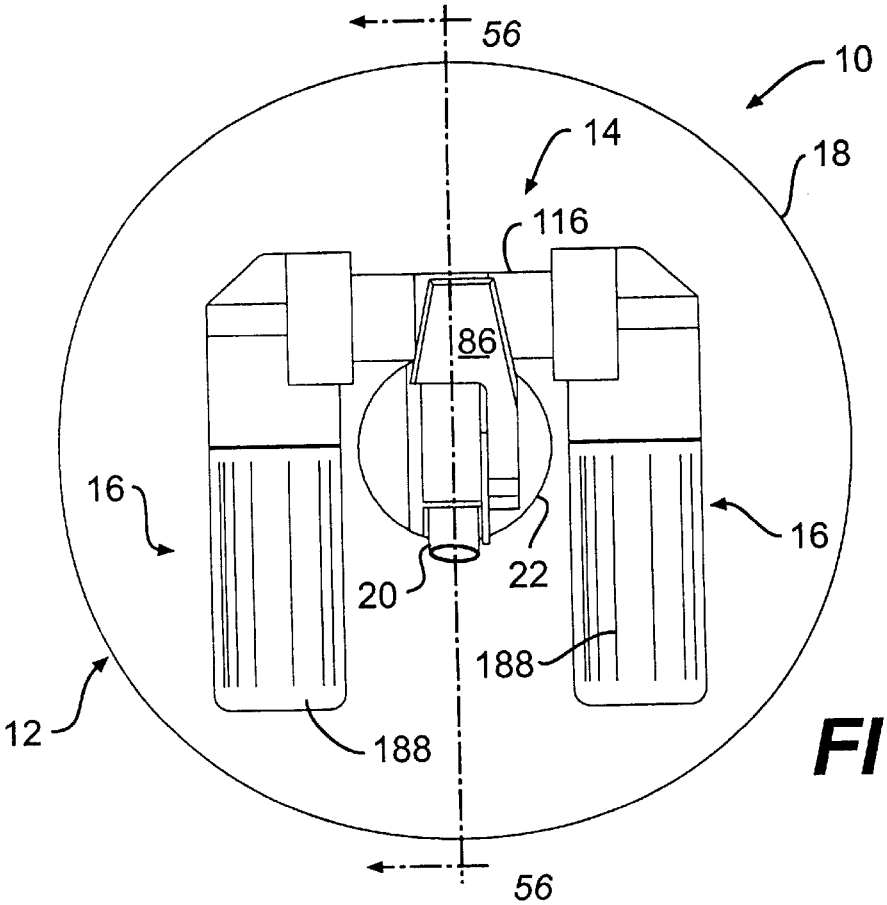
FIG. 55 is an enlarged front end view of the liquid dispenser taken generally along line 55—55 of FIG. 2 but showing the tap assembly in its closed-liquid-flow position.

FIGS. 55–56 show the lever 86 and cam lobe 88 rotated to their closed positions wherein the lever 86 abuts the first stop 44. The resilient flow control portion 38 of the delivery tube 20 is compressed, along a first imaginary line 196, between the relatively more rigid cam lobe 88 and the protrusion 58 of the tap cavity 40. Thus, the flattened flow control portion 38 blocks the flow of beverage from the container 18 to the outlet 36 of the delivery tube 20. The lever 86 and cam 84 arrangement advantageously eliminates the lever return spring and related cost found in the above prior art dispensers. It also provides the user with a relatively higher amount of leverage for actuation of the cam without having to overcome an opposing spring force. This allows the user to easily squeeze the resilient flow control portion 38 shut or open it. This extra leverage also advantageously allows the use of larger-sized delivery tubes (i.e., having larger cross-sectional flow areas) which are desirable for minimizing the formation of excessive foaming in the dispensed beverage.

With the beverage container 18 pressurized, the user can dispense beverage from the beverage dispenser 10 by rotating the lever 86 and cam lobe 88 to their opened positions shown in FIGS. 57–58. The cam lobe 88 abuts the second stop 46 and is thus retracted from the resilient flow control portion 38 of the delivery tube 20. The resiliency of the flattened flow control portion 38 enables it to naturally radially expand to its originally unflattened state.

During rotation of the cam lobe 88 towards its opened position, the combing teeth 92 angularly sweep across opposite sides of the flow control portion 38. If after extended use the resilient flow control portion 38 remains somewhat flattened due to compression along the first imaginary line 196, the combing teeth 92 compress opposite sides of the resilient flow control portion 38 along a second imaginary line 198 generally perpendicular to the first imaginary line 196. The combing teeth 92 advantageously ensure restoration of the resilient flow control portion 38 to its original outside diameter and substantially unrestricted fluid flow therethrough. Fluid communication is opened through the delivery tube 20 thereby releasing pressurized beverage from the container 18, through the suction tube 98 and into the diffuser 96. While these features of the subject invention have been described for application to a beverage dispenser, it can also be used for other dispensers of fluid such as intravenously-fed medicine, food or nutrients, and the like.

The relative position and orientation of the diffuser 96, spaced completely upstream of the resilient flow control portion 38, allows the diffuser 96 to fully condition the flow of liquid to desired characteristics such as reduced velocity, laminar flow, and appearance. This advantageously minimizes excessive foaming of the beverage and therefore minimizes filling time. The beverage continues flowing through the delivery tube 20 and then exits its outlet 36 and the front opening 50 of the tap 22. Removing beverage from the container 18 reduces the pressure therein and unseats the regulator piston 152 for another charge of pressurized gas delivered to the container 18.

The regulator piston ball 156 and return spring 158 function as a pressure relief valve for preventing excessive pressurization and possible failure (e.g., cracking or bursting) of the container 18, tap 22, and/or manifold 116. If the fluid pressure within the manifold 116 reaches a preselected pressure (for example, about 0.25 kPa/35 psi), the force of manifold gas pressure acting on the regulator piston ball 156 overcomes the opposing force of the return spring 158. The resultant force unseats the regulator piston ball 156 away from the vent opening 164. This allows fluid pressure to escape from the manifold 116, through the chamber 162, through the vent opening 164, through the vent passages of the regulator piston cover 160 and manifold plug (not shown) to ambient air. The regulator piston ball 156 remains unseated to vent excessive fluid pressure until the force of the manifold gas pressure acting on the regulator piston ball becomes less than the opposing force of the return spring 158.

Other aspects, objects, and advantages of this invention can be obtained from a study of the drawings, the disclosure, and the appended claims.

I claim:

1. A method of operating a tap adapted to dispense a fluid, said tap including a fluid delivery tube having a resilient flow control portion, said method comprising the steps of:

applying a first compressive force, along a first imaginary line, against the resilient flow control portion;

squeezing the resilient flow control portion under the first compressive force and thereby blocking fluid communication therethrough;

releasing the first compressive force from the resilient flow control portion; and positively decompressing the resilient flow control portion by applying a second compressive force in addition to any natural restoring force of said resilient flow control portion, along a second imaginary line different from said first imaginary line, against the resilient flow control portion for ensuring restoration of fluid communication therethrough.

2. A method of operating a tap adapted to dispense a fluid, said tap including a fluid delivery tube having a resilient flow control portion, said method comprising the steps of:

applying a first compressive force, along a first imaginary line, against the resilient flow control portion;

squeezing the resilient flow control portion under the first compressive force and thereby blocking fluid communication therethrough;

releasing the first compressive force from the resilient flow control portion; and applying a second compressive force, along a second imaginary line, against the resilient flow control portion for ensuring restoration of fluid communication therethrough, wherein said second compressive force is applied by combing opposite sides of the resilient flow control portion.

3. The method of claim 1, wherein said restored fluid communication through the resilient flow control portion is substantially unrestricted.

4. The method of claim 1, wherein said second imaginary line is generally perpendicular to said first imaginary line.

5. A tap assembly adapted for a fluid dispenser having a source of fluid, said tap assembly comprising:

a tap having a tap cavity;

a fluid delivery tube positioned in the tap cavity, said delivery tube including an inlet, an outlet, and a resilient flow control portion therebetween, said inlet adapted to be in fluid communication with the source of fluid, said outlet communicating outside the tap; and movable control valve means for selectively i) compressing said resilient flow control portion, when the control valve means is moved to a closed position, thereby closing fluid communication between the inlet and the outlet of the delivery tube and ii) not compressing said resilient flow control portion, when the control valve means is moved to an opened position, thereby opening fluid communication between the inlet and the outlet of the delivery tube; and decompression means for ensuring decompression of the resilient flow control portion of the delivery tube when the control valve means is moved to its opened position.

6. The tap assembly of claim 5, wherein said decompression means includes a pair of spaced-apart combing teeth operably movable with the control valve means, said combing teeth slidably positioned adjacent opposite sides of said resilient flow control portion when the control valve means is moved to its opened position, said combing teeth spaced away from the resilient flow control portion when the control valve means is moved to its closed position.

7. The tap assembly of claim 5, further including a diffuser having a diffuser inlet, a diffuser outlet, and a diverging passage extending from the diffuser inlet to the diffuser outlet, said diffuser inlet adapted to be in fluid communication with the source of fluid, said diffuser outlet arranged in fluid communication with the fluid delivery tube and positioned upstream of said resilient flow control portion.

8. The tap assembly of claim 7, wherein the diffuser outlet is directly connected to the inlet of the fluid delivery tube.

9. The tap assembly of claim 5, further including a suction tube and a weight, said suction tube having a suction tube inlet and a suction tube outlet, said weight connected to the suction tube inlet, said suction tube outlet connected to the diffuser inlet.

10. A tap assembly adapted for a fluid dispenser having a source of fluid, said tap assembly comprising:

a tap having a tap cavity;

a fluid delivery tube positioned in the tap cavity, said delivery tube including an inlet, an outlet, and a resilient flow control portion therebetween, said inlet adapted to be in fluid communication with the source of fluid, said outlet communicating outside the tap; and a rotatable cam positioned in the tap cavity, said cam having an eccentric cam lobe rotatably movable therewith between i) a first angular position at which the cam lobe compresses said resilient flow control portion without aid of additional mechanical spring force thereby closing fluid communication between the inlet and the outlet of the delivery tube and ii) a second angular position at which the cam lobe is retracted from the resilient flow control portion without overcoming additional opposing mechanical spring force thereby opening fluid communication between the inlet and the outlet of the delivery tube.

11. A tap assembly adapted for a fluid dispenser having a source of fluid, said tap assembly comprising:

a tap having a tap cavity;

a fluid delivery tube positioned in the tap cavity, said delivery tube including an inlet, an outlet, and a resilient flow control portion therebetween, said inlet adapted to be in fluid communication with the source of fluid, said outlet communicating outside the tap; and a cam positioned in the tap cavity, said cam having a cam lobe rotatably movable therewith between i) a first angular position at which the cam lobe compresses said resilient flow control portion thereby closing fluid communication between the inlet and the outlet of the delivery tube and ii) a second angular position at which the cam lobe is retracted from the resilient flow control portion thereby opening fluid communication between the inlet and the outlet of the delivery tube, further including decompression means for ensuring decompression of the resilient flow control portion of the delivery tube and thereby restoring fluid communication therethrough when the cam lobe is moved to its second angular position.

12. The tap assembly of claim 11, wherein said decompression means includes a pair of spaced-apart combing teeth operably rotatable with the cam lobe, said combing teeth slidably positioned adjacent opposite sides of said resilient flow control portion when the cam lobe is at its second angular position, said combing teeth spaced away from the resilient flow control portion when the cam lobe is at its first angular position.

13. The tap assembly of claim 10, further including a lever connected to the cam and movable to rotate the cam lobe between its first and second angular positions.

14. The tap assembly of claim 13, wherein said tap includes a first stop and a second stop, said lever abutting the first stop at the first angular position of the cam lobe, said lever abutting the second stop at the second angular position of the cam lobe.

15. A tap assembly adapted for a fluid dispenser having a source of fluid, said tap assembly comprising:

a tap having a tap cavity;

a fluid delivery tube positioned in the tap cavity, said delivery tube including an inlet, an outlet, and a resilient flow control portion therebetween, said inlet adapted to be in fluid communication with the source of fluid, said outlet communicating outside the tap; and a rotatable cam positioned in the tap cavity, said cam having an eccentric cam lobe rotatable movable therewith between i) a first angular position at which the cam lobe compresses said resilient flow control portion without aid of additional mechanical spring force thereby closing fluid communication between the inlet and the outlet of the delivery tube and ii) a second angular position at which the cam lobe is retracted from the resilient flow control portion without overcoming opposing additional mechanical spring force thereby opening fluid communication between the inlet and the outlet of the delivery tube, wherein said tap cavity defines a protrusion extending adjacent to the resilient flow control portion of the delivery tube, said resilient flow control portion being compressed between the cam lobe and the protrusion when the cam lobe is rotated to its first position.

16. A modular tap assembly adapted for a fluid mixture dispenser having a source of a first fluid and multiple sources of a second pressurized fluid, said tap assembly comprising:

a manifold having a common rail passage and a plurality of branch inlets separately connected to the common rail passage wherein each branch passage is adapted to be in selective fluid communication with a respective one of the multiple sources of pressurized second fluid; and a tap including a tap chamber having an inlet connected to the common rail passage of the manifold and an outlet adapted to be in fluid communication with the source of first fluid.

17. The tap assembly of claim 16, wherein said first fluid is a liquid and said second pressurized fluid is a gas.

18. The tap assembly of claim 16, further including check valve means for communicating the second pressurized fluid from the manifold to the tap chamber and for blocking fluid flow in the reverse direction, said check valve means including a one-way check valve positioned between the common rail passage of the manifold and the inlet of the tap chamber.

19. The tap assembly of claim 16, further including piloting means for accurately guiding the manifold and tap into unique alignment with one another during assembly thereof.

20. A modular tap assembly adapted for a fluid mixture dispenser having a source of a first fluid and multiple sources of a second pressurized fluid, said tap assembly comprising:

a manifold having a common rail passage and a plurality of branch inlets separately connected to the common rail passage wherein each branch passage is adapted to be in selective fluid communication with a respective one of the multiple sources of pressurized second fluid;

a tap including a tap chamber having an inlet connected to the common rail passage of the manifold and an outlet adapted to be in fluid communication with the source of first fluid, further including piloting means for accurately guiding the manifold and tap into unique alignment with one another during assembly thereof, wherein said piloting means includes a pair of spaced-apart flanges extending from the tap and at least one guide extending from the manifold, said flanges defining a slot therebetween, said guide of the manifold slidably positioned in said slot of the tap during assembly thereof.

21. A modular tap assembly adapted for a fluid mixture dispenser having a source of a first fluid and multiple sources of a second pressurized fluid, said tap assembly comprising:

a manifold having a common rail passage and a plurality of branch inlets separately connected to the common rail passage wherein each branch passage is adapted to be in selective fluid communication with a respective source of the pressurized second fluid;

a tap including a tap chamber having an inlet connected to the common rail passage of the manifold and an outlet adapted to be in fluid communication with the source of first fluid, wherein one of the tap and the manifold further includes a pair of spaced-apart integrally-formed elastic clips extending therefrom and the other of the tap and the manifold includes a pair of spaced-apart integrally-formed clip holders, said manifold and said tap removably connected together by a snap fit of each clip to a respective clip holder.

22. The tap assembly of claim 21, wherein said clips are formed on the tap and said clip holders are formed on the manifold, said clips have oppositely-facing support surfaces, said manifold having an outer surface portion conforming with said support surfaces of the clips and positioned in matable contact therewith.

23. The tap assembly of claim 22, wherein said support surfaces of the clips are shaped concave and the outer surface portion of the manifold is shaped convex.

24. A tap assembly adapted for a fluid mixture dispenser having a source of a first fluid and multiple sources of pressurized fluid different from the first fluid, said tap assembly comprising:

a manifold having a common rail passage and a plurality of branch inlets separately connected to the common rail passage wherein each branch passage is adapted to be in selective fluid communication with a respective one of the multiple sources of pressurized fluid; and a tap including a tap chamber having an inlet connected to the common rail passage of the manifold and an outlet adapted to be in fluid communication with the source of first fluid.

25. The tap assembly of claim 24, wherein said first fluid is a liquid and said multiple sources of pressurized fluid are multiple sources of pressurized gas.

26. The tap assembly of claim 25, wherein said first fluid is a liquid beverage.

27. The tap assembly of claim 26, wherein said liquid beverage is selected from the group of beer, wine, and soft drinks.

28. The tap assembly of claim 25, wherein said multiple sources of pressurized gas each include a removable compressed gas cartridge containing said pressurized gas.

29. The tap assembly of claim 28, wherein said pressurized gas is selected from the group of carbon dioxide gas and nitrogen gas.

30. The tap assembly of claim 24, further including check valve means for communicating the multiple sources of pressurized fluid from the manifold to the tap chamber and for blocking fluid flow in the reverse direction, said check valve means including a one-way check valve positioned between the common rail passage of the manifold and the inlet of the tap chamber.

* * * * *